US010365600B2

(12) United States Patent
Tsukamoto

(10) Patent No.: US 10,365,600 B2
(45) Date of Patent: Jul. 30, 2019

(54) BELT DEVIATION CORRECTION DEVICE FIXING DEVICE, IMAGE FORMING APPARATUS, AND BELT DEVIATION CORRECTION METHOD

(71) Applicant: Sharp Kabushiki Kaisha, Sakai, Osaka (JP)

(72) Inventor: Kimihide Tsukamoto, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 15/949,349

(22) Filed: Apr. 10, 2018

(65) Prior Publication Data

US 2018/0299811 A1 Oct. 18, 2018

(30) Foreign Application Priority Data

Apr. 14, 2017 (JP) ..... 2017-080828
Dec. 5, 2017 (JP) ..... 2017-233101

(51) Int. Cl.
*G03G 15/20* (2006.01)
*G03G 15/00* (2006.01)

(52) U.S. Cl.
CPC ..... *G03G 15/50* (2013.01); *G03G 15/2064* (2013.01); *G03G 15/55* (2013.01); *G03G 2215/00156* (2013.01); *G03G 2215/2019* (2013.01); *G03G 2215/2025* (2013.01); *G03G 2215/2032* (2013.01)

(58) Field of Classification Search
CPC .... G03G 15/204; G03G 15/501; G03G 15/55; G03G 2215/2019; G03G 2215/2025; G03G 2215/2032; G03G 2215/2035; G03G 2215/2038; G03G 2215/2041; G03G 15/2064
See application file for complete search history.

(56) References Cited

U.S. PATENT DOCUMENTS 8,733,542 B2 5/2014 Yamaoka
2010/0158553 A1* 6/2010 Ueno ..... G03G 15/2064 399/67

FOREIGN PATENT DOCUMENTS

JP 2012-198293 A 10/2012
JP 2014-115585 A 6/2014

* cited by examiner

*Primary Examiner* — Hoang X Ngo
(74) *Attorney, Agent, or Firm* — Keating & Bennett, LLP

(57) ABSTRACT

A belt deviation correction device for correcting a deviation of an endless belt wound around a plurality of rollers includes a pressing roller that is pressed from outside the endless belt wound around the plurality of rollers. The pressing roller is configured to swing in such a way as to be inclined with respect to the plurality of rollers. A deviation of the endless belt in a direction of an axis of rotation of the plurality of rollers is corrected by swinging the pressing roller.

17 Claims, 17 Drawing Sheets

(PRESSURE RELEASE STATE)

(PRESSURE RELEASE STATE)

(PRESSURE RELEASE STATE)

(DURING PRESS ACTION: PRESSED STATE)

(DURING DEVIATION CORRECTION ACTION: INCLINED STATE OF PRESSURE ROLLER IN FIRST DIRECTION)

(DURING PRESS ACTION: PRESSED STATE)

(DURING DEVIATION CORRECTION ACTION: INCLINED STATE OF PRESSURE ROLLER IN FIRST DIRECTION)

(DURING PRESS ACTION: PRESSED STATE)

(DURING DEVIATION CORRECTION ACTION: INCLINED STATE OF PRESSURE ROLLER IN SECOND DIRECTION)

(DURING PRESS ACTION: PRESSED STATE)

(DURING DEVIATION CORRECTION ACTION: INCLINED STATE OF PRESSURE ROLLER IN SECOND DIRECTION)

(DURING PRESS ACTION: PRESSED STATE)

(DURING DEVIATION CORRECTION ACTION: PRESSURE ROLLER IN PARALLEL STATE)

(DURING PRESS ACTION:
PRESSED STATE)

(DURING DEVIATION CORRECTION ACTION:
PRESSURE ROLLER IN PARALLEL STATE)

BELT DEVIATION CORRECTION DEVICE FIXING DEVICE, IMAGE FORMING APPARATUS, AND BELT DEVIATION CORRECTION METHOD

BACKGROUND

1. Field

The present disclosure relates to a belt deviation correction device, a fixing device, an image forming apparatus such as a copying machine, a multifunctional machine, a printer, or a facsimile apparatus, and a belt deviation correction method.

2. Description of the Related Art

An endless belt wound around a plurality of belt rollers often deviates in a cross direction orthogonal to a direction of revolution of the belt, for example, due to variation among components. For this reason, there has conventionally been proposed means for correcting a belt deviation. For example, in order to correct a belt deviation of an endless belt that is stretched over a plurality of rollers and driven to rotate, Japanese Unexamined Patent Application Publication No. 2012-198293 discloses a configuration in which at least one of the plurality of rollers over which the endless belt is stretched is tilted (see paragraph [0034] and FIGS. 4 and 5 of Japanese Unexamined Patent Application Publication No. 2012-198293).

However, the configuration described in Japanese Unexamined Patent Application Publication No. 2012-198293, in which at least one of the plurality of rollers over which the endless belt is stretched is tilted, complicates the configuration of members for correcting a belt deviation, inviting an increase in size of the device accordingly.

SUMMARY

It is desirable to provide a belt deviation correction device, a fixing device, an image forming apparatus, and a belt deviation correction method that make it possible to, in correcting a deviation of an endless belt wound around a plurality of belt rollers, simplify the configuration of members for correcting a belt deviation and thereby achieve a reduction in size of the device.

It is desirable to provide the following belt deviation correction device, the following fixing device, the following image forming apparatus, and the following belt deviation correction method.

(1) Belt Deviation Correction Device

According to an aspect of the disclosure, there is provided a belt deviation correction device for correcting a deviation of an endless belt wound around a plurality of rollers, including: a pressing roller that is pressed from outside the endless belt wound around the plurality of rollers, wherein the pressing roller is configured to swing in such a way as to be inclined with respect to the plurality of rollers, and a deviation of the endless belt in a direction of an axis of rotation of the plurality of rollers is corrected by swinging the pressing roller.

(2) Fixing Device

According to an aspect of the disclosure, there is provided a fixing device including: the belt deviation correction device according to the present disclosure, wherein the plurality of rollers include a fixing roller and a heating roller, the pressing roller is a pressure roller, and the endless belt is a fixing belt.

(3) Image Forming Apparatus

According to an aspect of the disclosure, there is provided an image forming apparatus including the belt deviation correction device according to the present disclosure; or the fixing device according to the present disclosure.

(4) Belt Deviation Correction Method

According to an aspect of the disclosure, there is provided a belt deviation correction method for correcting a deviation of an endless belt wound around a plurality of rollers, including: correcting a deviation of the endless belt in a direction of an axis of rotation of the plurality of rollers by swinging a pressing roller so that the pressing roller is inclined with respect to the plurality of rollers, the pressing roller being pressed from outside the endless belt wound around the plurality of rollers.

DESCRIPTION OF THE EMBODIMENTS

The following describes an embodiment of the present disclosure with reference to the drawings. The following descriptions assigns identical components identical signs. The same applies to their names and functions. Therefore, a detailed description of them is not repeated.

Overall Configuration of Image Forming Apparatus

Figure 1:
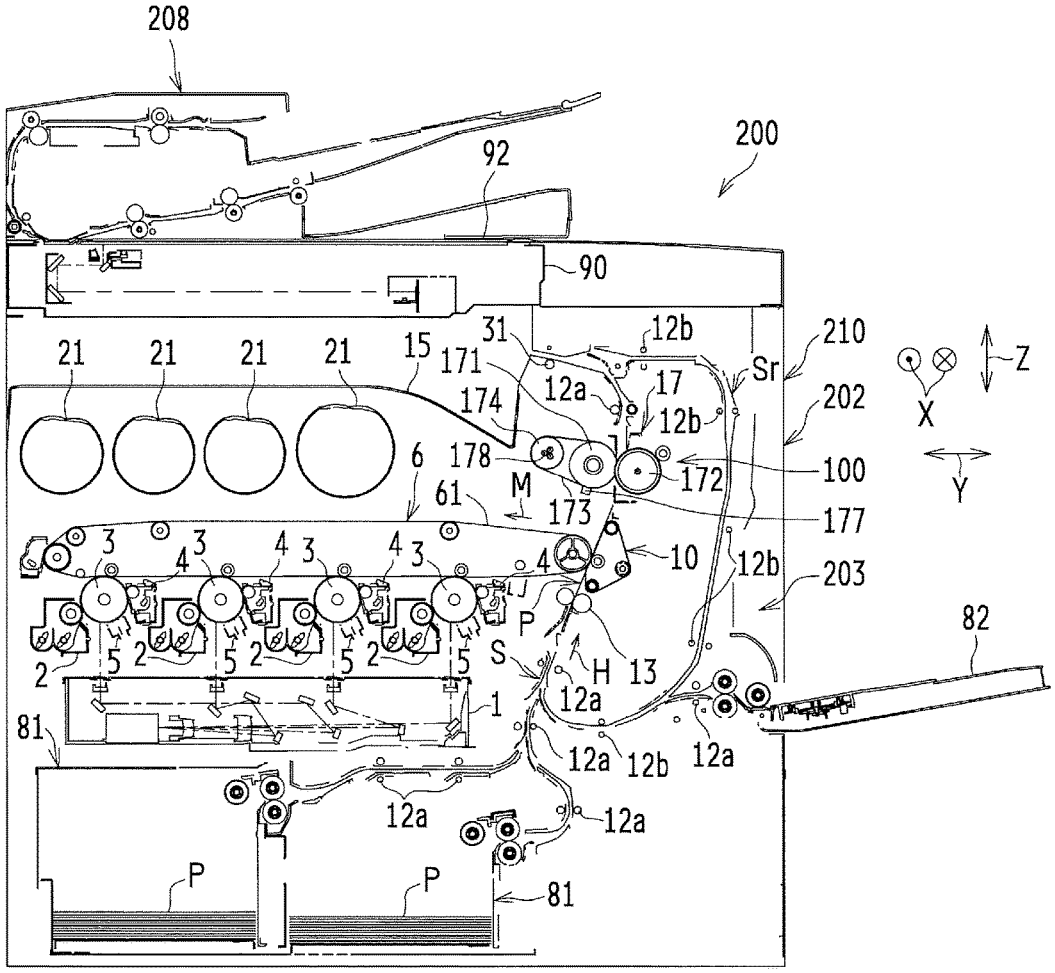
FIG. 1 is a schematic cross-sectional view of an image forming apparatus including a fixing device having a drive mechanism according to an embodiment of the present disclosure as seen from the front.

FIG. 1 is a schematic cross-sectional view of an image forming apparatus 200 including a fixing device 17 having a drive mechanism 100 according to an embodiment of the present disclosure as seen from the front. It should be noted that the sign X represents a cross direction (depth direction), the sign Y represents a horizontal direction Y that is orthogonal to the cross direction X, and the sign Z represents a vertical direction. The same applies to FIGS. 2 to 16B described below.

The image forming apparatus 200 shown in FIG. 1 is a color image forming apparatus that electrophotographically forms multicolor and monochromatic images onto sheets P such as recording paper in accordance with image data read by an image reading device 90 or image data transmitted from an outside source. It should be noted that the image forming apparatus 200 may be a monochromatic image forming apparatus. Alternatively, the image forming apparatus 200 may be a color image forming apparatus of another form.

The image forming apparatus 200 includes a document feed device 208 and an image forming apparatus main body 210, and the image forming apparatus main body 210 is provided with an image forming section 202 and a sheet conveyance system 203.

The image forming section 202 includes an exposure device 1, a plurality of developing devices 2, a plurality of photoreceptor drums 3, a plurality of photoreceptor cleaner sections 4, a plurality of chargers 5, a primary transfer belt device 6, a plurality of toner cartridge devices 21, and the fixing device 17. Further, the sheet conveyance system 203 includes a paper feed tray 81, a manual paper feed tray 82, and a paper output tray 15.

Provided on top of the image forming apparatus main body 210 is a document platen 92, made of transparent glass, on which a document (not illustrated) is placed. Provided below the document platen 92 is the image reading device 90, which is used to read an image of a document. Further, the document feed device 208 is provided on an upper side of the document platen 92. An image of a document as read by the image reading device 90 is sent as image data to the image forming apparatus main body 210, and an image formed on the basis of the image data is recorded onto a sheet P in the image forming apparatus main body 210.

Image data that is handled in the image forming apparatus 200 corresponds to a color image having a plurality of colors (which, in this example, are black (K), cyan (C), magenta (M), and yellow (Y)). Therefore, the plurality of (in this example, four) developing devices 2, the plurality of (in this example, four) photoreceptor drums 3, the plurality of (in this example, four) photoreceptor cleaner sections 4, the plurality of (in this example, four) chargers 5, and the plurality of (in this example, four) toner cartridge devices 21 are configured to form plural types (in this example, four types) of image corresponding to the respective colors (which, in this example, are black, cyan, magenta, and yellow), and constitute a plurality of (in this example, four) image forming stations.

In forming an image in the image forming apparatus 200, a sheet P is fed from the paper feed tray 81 or the manual paper feet tray 82 and conveyed to a registration roller 13 by conveying rollers 12*a* provided along a sheet conveyance path S. Next, the sheet P is conveyed by a secondary transfer belt device 10 at such a timing that the sheet P and a toner image on a primary transfer belt 61 that moves around in a direction of revolution M in the primary transfer belt device 6 match, and the toner image is transferred onto the sheet P. After that, unfixed toner on the sheet P is thermally fused and fixed by passing the sheet P through a space between a fixing roller 171 and a pressure roller 172 in the fixing device 17, and the sheet P is ejected onto the paper output tray 15 via the conveying rollers 12*a* and a paper output roller section 31. Further, in a case where the image forming apparatus 200 forms an image on the back side of the sheet P as well as the front side, the sheet P is conveyed from the paper output roller section 31 in the opposite direction to a reversal path Sr, guided again toward the registration roller 13 with its front and back sides reversed via a conveying roller 12*b*, and ejected onto the output tray 15 with a toner image fixed on the back side of the sheet P as in the case of the front side of the sheet P. Thus, the image forming apparatus 200 completes a series of printing actions.

It should be noted that it is also possible to form a monochromatic image with use of at least one of the four image forming stations and transfer the monochromatic image onto the primary transfer belt 61 of the primary transfer belt device 6. As with a color image, this monochromatic image is transferred from the first transfer belt 61 to a sheet P and fixed onto the sheet P.

Fixing Device

The following describes an example in which a belt deviation correction device 300 according to the present embodiment is applied to the fixing device 17, which conforms to a belt fixing method.

Figure 2:
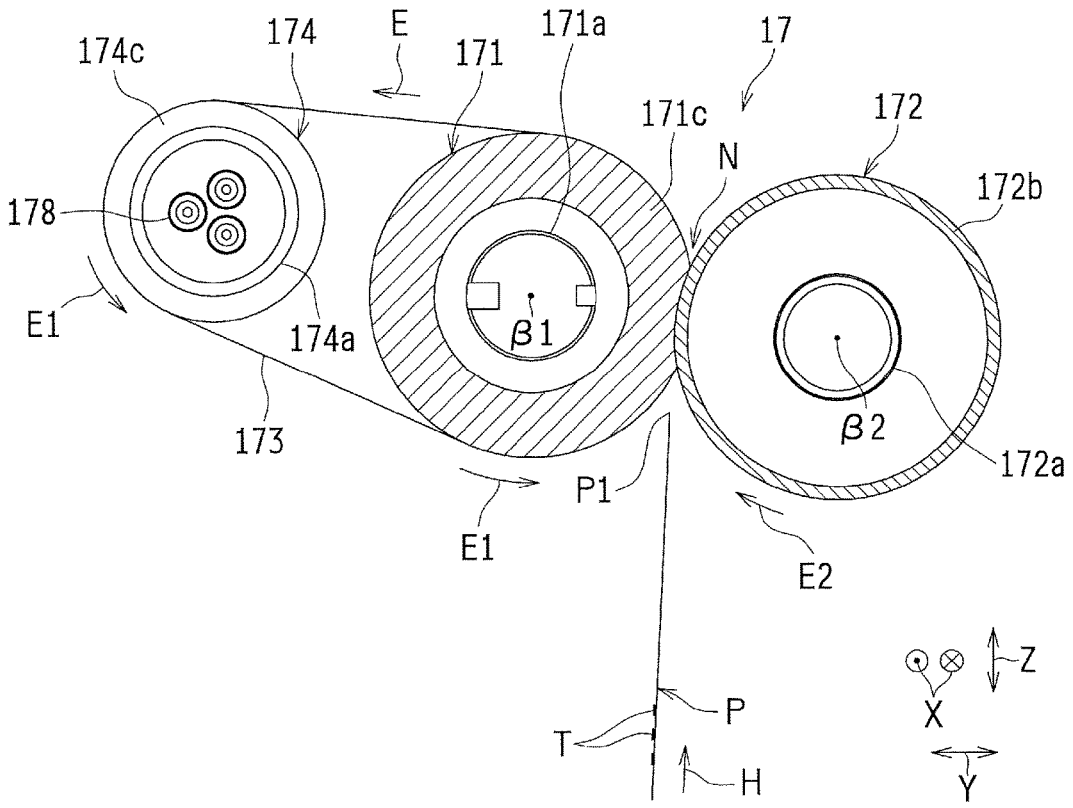
FIG. 2 is a front view schematically showing a configuration of the fixing device shown in FIG. 1.
Figure 3:
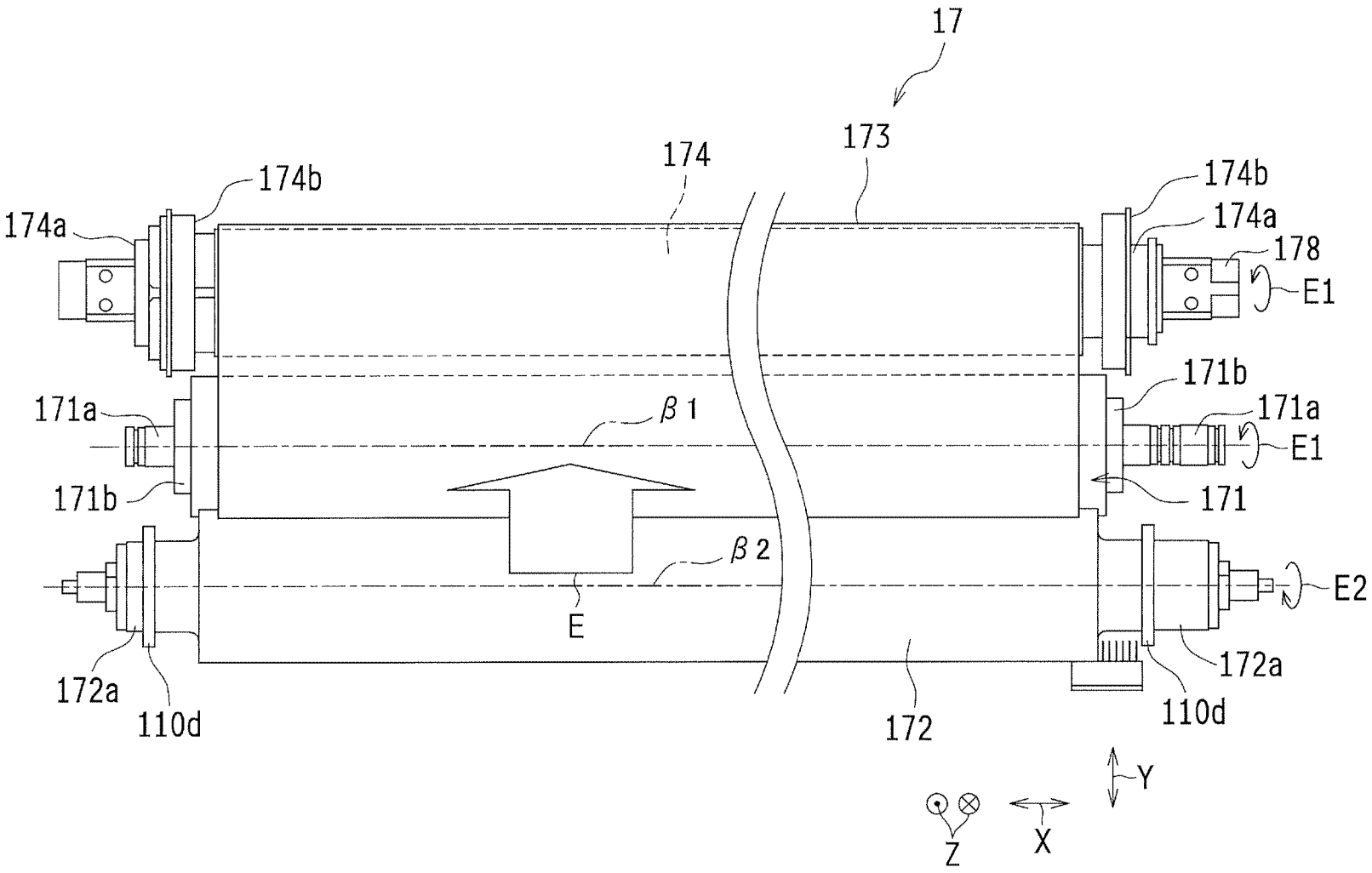
FIG. 3 is a plan view schematically showing the configuration of the fixing device shown in FIG. 1.
Figure 4:
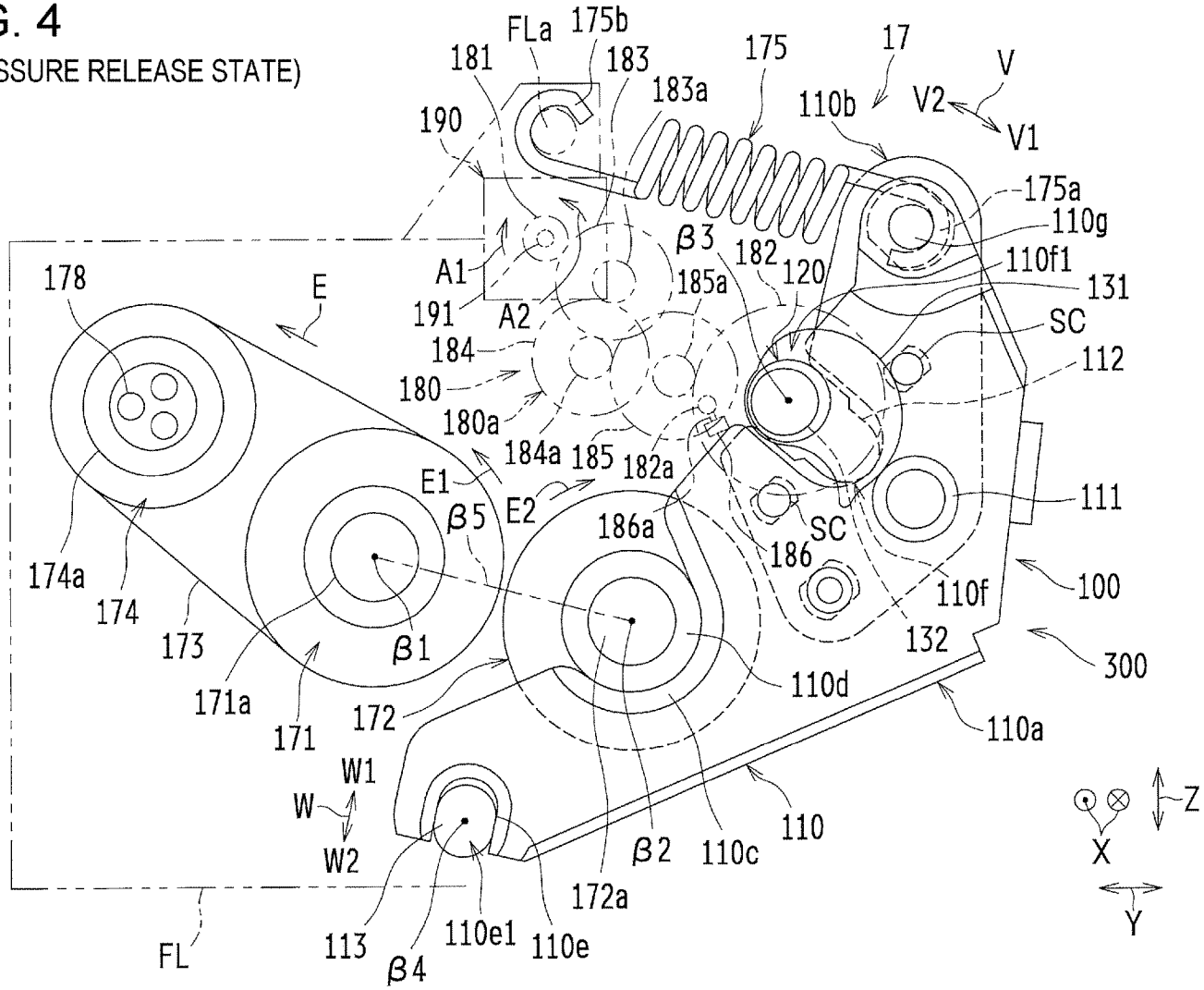
FIG. 4 is a schematic front view of the drive mechanism, a drive transmission mechanism, and a rotary drive source in the fixing device shown in FIG. 1.

FIGS. 2 and 3 are front and plan views, respectively, schematically showing a configuration of the fixing device 17 shown in FIG. 1. Further, FIG. 4 is a schematic front view of the drive mechanism 100, a drive transmission mechanism 180, and a rotary drive source 190 in the fixing device 17 shown in FIG. 1. FIG. 4 shows a pressure release state of the pressure roller 172 against the fixing roller 171. It should be noted that FIGS. 2 and 3 omit to illustrate some of the constituent elements and the like of the drive mechanism 100 shown in FIG. 4. Further, FIG. 4 omits to illustrate a configuration on a second side (which, in this example, is a rear side), because, as will be described later, the configuration is substantially the same as a configuration on a first side (which, in this example, is a front side) except for a configuration for swinging the pressure roller 172 in swinging directions W. The same applies to FIG. 5, FIG. 6, FIG. 7, and FIGS. 10 to 16B described below.

In the present embodiment, as shown in FIGS. 2 to 4, the drive mechanism 100 includes a first roller (which, in this example, is the fixing roller 171) and a second roller (which, in this example, is the pressure roller 172). The second roller clamps a conveyed body (which, in this example, is a fixing belt 173) against the first roller.

Further, in the present embodiment, the drive mechanism 100 further includes a third roller (which, in this example, is a heating roller 174). The conveyed body (which, in this example, is the fixing belt 173) is an endless belt that is wound around the first roller (which, in this example, is the fixing roller 171) and the third roller (which, in this example, is the heating roller 174).

Specifically, the fixing device 17 includes a plurality of (in this example, two) rollers (which, in this example, are the fixing roller 171 and the heating roller 174) including the fixing roller 171 and the endless fixing belt 173 wound around the fixing roller 171 and the heating roller 174.

The fixing device 17 further includes the pressure roller 172 so that a fixing nip zone N (which is an example of a nip section) is formed between the fixing belt 173 and the pressure roller 172 in a state where the fixing roller 171 and the pressure roller 172 are pressed against each other by a biasing member 175 (which, in this example, is a pressure spring such as a coil spring) with the fixing belt 173 therebetween. The fixing device 17 further includes the drive mechanism 100. As will be described later, the drive mechanism 100 acts as means for pressing the pressure roller 172 against the fixing roller 171, adjusting the pressure of the pressure roller 172 against the fixing roller 171, and releasing the pressure roller 172 from being pressed against the fixing roller 171 and acts as means for correcting a deviation of the fixing belt 173. It should be noted that the drive mechanism 100 will be described in detail later.

The fixing roller 171 is configured to face an unfixed toner image T on a sheet P with the fixing belt 173 interposed therebetween, and the heating roller 174 is configured to heat the fixing belt 173.

Specifically, the fixing roller 171 has a rotating shaft 171*a* rotatably provided in a main body (specifically, a main body frame FL) of the fixing device 17 via bearings 171*b*. The fixing roller 171 faces the unfixed toner image T on the sheet P between the fixing belt 173 and the pressure roller 172 while clamping the fixing belt 173 together with the pressure roller 172 and fixes the unfixed toner image T. The fixing roller 171 has an elastic layer 171*c* (e.g. an elastic layer made of a rubber member such as silicone rubber).

The pressure roller 172 has a rotating shaft 172*a* rotatably provided in an actuated member 110 via bearings 110*d*. The pressure roller 172 has an elastic layer 172*b* (e.g. an elastic layer made of a rubber member such as silicone rubber).

The fixing belt 173 includes a substrate (not illustrated) (e.g. a substrate made of metal such as nickel) and an elastic layer (e.g. an elastic layer made of a rubber member such as silicone rubber) (not illustrated) provided on the substrate.

Further, the heating roller 174 has a rotating shaft 174*a* rotatably provided in the main body (specifically, the main body frame FL) of the fixing device 17 via bearings 174*b*. The heating roller 174 includes a heat source 178 such as a halogen heater, and by being heated by the heat source 178, the heat roller 174 heats the fixing belt 173. The heating roller 174 includes a cylindrical cored bar. The heat source 178, which heats the heating roller 174, is provided inside the heating roller 174. As a result of that, the heating roller 174 is heated by the heat source 178 and the fixing belt 173 is heated by the transmission of heat from the heating roller 174 to the fixing belt 173. The heating roller 174 has a metallic tube 174*c* (e.g. an aluminum tube).

In a state where the fixing device 17 described above is fitted in the image forming apparatus main body 210, a drive mechanism (not illustrated) such as gears on the side of the image forming apparatus main body 210 intermesh with gears (not illustrated) provided in the rotation shaft 171*a* of the fixing roller 171 and the transmission of rotary drive force from the drive mechanism on the side of the image forming apparatus main body 210 to the rotating shaft 171*a* of the fixing roller 171 via the gears drives the fixing roller 171 to rotate in a predetermined direction of rotation E1. As the fixing roller 171 rotates, the fixing belt 173 moves around in a direction of revolution E, which is the same direction as the direction of rotation E1 of the fixing roller 171, and the heating roller 174 rotates in the direction of rotation E1; furthermore, the pressure roller 172 is driven to rotate in a direction E2 opposite to the direction of rotation E1 of the fixing roller 171. Moreover, a sheet P being conveyed in a sheet conveyance direction H with an unfixed toner image T formed thereon is received, conveyed by being held between the fixing belt 173 and the pressure roller 172, and heated under pressure in the fixing nip zone N. Thus, the unfixed toner image T on the sheet P is fused, mixed, pressed, and thermally fixed.

It should be noted that the fixing device 17 may include a tension roller that is placed inside or outside the fixing belt 173 and presses the fixing belt 173 outward or inward so as to apply tension to the fixing belt 173. Instead of or in addition to the tension roller, the fixing device 17 may include biasing members (e.g. coil springs) that apply biasing force to both ends of the rotating shaft 174*a* of the heating roller 174 toward a side opposite to the fixing roller 171. The fixing roller 171 and/or the pressure roller 172 may be provided with a heat source(s) 178. Further, in a case where the tension roller is provided, the tension roller may be provided with a heat source 178. Further, in a case where the fixing belt 173 is further wound around other rollers, at least one of the other rollers may be provided with a heat source 178.

Belt Deviation Correction Device

The fixing device 17 includes a plurality of rollers (which, in this example, are the fixing roller 171 and the heating roller 174) and an endless belt (which, in this example, is the fixing belt 173). The fixing belt 173 is wound around the fixing roller 171 and the heating roller 174. The fixing belt 173 is configured to be able to transmit heat from the heating roller 174 to the fixing roller 171. The fixing device 17 further includes a pressing roller (which, in this example, is the pressure roller 172). The pressure roller 172 is pressed from outside the fixing belt 173 wound around the fixing roller 171 and the heating roller 174. In this example, the fixing device 17 is configured such that the pressure roller 172 is pressed against the fixing roller 171 with the fixing belt 173 interposed therebetween. Further, the fixing belt 173 is configured to be heated by the heat source 178 provided inside the heating roller 174 and maintained at a predetermined fixing temperature in accordance with a signal from a temperature sensing section 177 (specifically, a temperature sensor such as a thermistor).

Moreover, the pressure roller 172 is configured to swing so as to be inclined with respect to the fixing roller 171 and the heating roller 174. The fixing roller 17 is configured such that a deviation of the fixing belt 173 in the direction of an axis of rotation β1 of the fixing roller 171 and the heating roller 174 is corrected by swinging the pressure roller 172.

The present embodiment swings the pressure roller 172, which is pressed from outside the fixing belt 173, in order to correct a belt deviation of the fixing belt 173. This makes it possible to simplify the configuration of members for correcting a belt deviation, thereby making it possible to achieve a reduction in size of the device.

Drive Mechanism

The drive mechanism serves to drive a plurality of actuated parts that are different from each other. Incidentally, there has conventionally been known a drive mechanism that drives a plurality of actuated parts that are different from each other (see, for example, Japanese Unexamined Patent Application Publication No. 2014-115585).

Specifically, Japanese Unexamined Patent Application Publication No. 2014-115585 discloses a configuration in which a meandering (deviation) of a medium on which recording is performed is corrected through adjusting the entire pressing load of a pressure roller by rotating a moving cam within a moving cam through-hole via a moving cam shaft by means of a moving cam motor and moving a pressing cam mechanism section toward the pressure roller via a moving cam plate and through adjusting the lateral balance of the pressing load of the pressure roller against a heating roller via an arm member by rotating a pair of pressing cams that are different in phase from each other in accordance with a detection signal from a meandering amount detector by means of a pressing cam motor.

That is, the configuration described in Japanese Unexamined Patent Application Publication No. 2014-115585 is such that two drive sources (i.e. the pressing cam motor and the moving cam motor) rotate the pair of pressing cams and the moving cam to actuate the arm member (pressing actuated part) and the moving cam plate (moving actuated part), respectively.

However, in a conventional drive mechanism such as that described in Japanese Unexamined Patent Application Publication No. 2014-115585, drive sources are individually provided for a plurality of actuated parts. This makes it difficult to reduce the size of the drive mechanism. Moreover, this complicates a control configuration for individually actuating the plurality of actuated parts.

Accordingly, it is desirable to achieve a reduction in size of a drive mechanism that drives a plurality of actuated parts that are different from each other and simplify a control configuration for individually actuating the plurality of actuated parts.

In this respect, in the present embodiment, the drive mechanism 100 serves to drive a plurality of actuated parts (which, in this example, are a first engagement part 111 [which is an example of a first actuated part] and a second engagement part 112 [which is an example of a second actuated part]) that are different from each other in order to swing the pressure roller 172.

The drive mechanism 100 may include a single drive part (which, in this example, is a rotary drive shaft 120) and a plurality of actuating parts (which, in this example, are a first cam 131 [which is an example of a first cam] and a second cam 132 (which is an example of a second cam]).

To the single drive part (which, in this example, is the rotary drive shaft 120), drive force from a single drive source (which, in this example, is the rotary drive source 190) is transmitted.

The plurality of actuating parts (which, in this example, are the first cam 131 and the second cam 132) are provided on the single drive part (which, in this example, is the rotary drive shaft 120) so that in actuating the first actuated part (which, in this example, is the first engagement part 111) and the second actuated part (which, in this example, is the second engagement part 112) of the plurality of actuated parts (which, in this example, are the first engagement part 111 and the second engagement part 112) separately with drive force from the single drive part (which, in this example, is the rotary drive shaft 120), a first action (which, in this example, is a roller press action) on the first actuated part (which, in this example, is the first engagement part 111) and a second action (which, in this example, is a belt deviation correction action) on the second actuated part (which, in this example, is the second engagement part 112) do not affect each other.

The present embodiment, which uses the single drive source (which, in this example, is the rotary drive source 190) to drive the plurality of actuating parts (which, in this example, are the first cam 131 and the second cam 132), makes it possible to save space in which to provide the single drive source (which, in this example, is the rotary drive source 190), thus making it possible to achieve a reduction in size of the drive mechanism 100. Moreover, the present embodiment makes it possible to achieve a reduction in cost of the drive mechanism 100. Furthermore, because of the configuration in which in actuating the first actuated part (which, in this example, is the first engagement part 111) and the second actuated part (which, in this example, is the second engagement part 112) of the plurality of actuated parts (which, in this example, are the first engagement part 111 and the second engagement part 112) separately with drive force from the single drive part (which, in this example, is the rotary drive shaft 120), the first action (which, in this example, is the roller press action) on the first actuated part (which, in this example, is the first engagement part 111) and the second action (which, in this example, is the belt deviation correction action) on the second actuated part (which, in this example, is the second engagement part 112) do not affect each other, the first action (which, in this example, is the roller press action) in which a first actuating part (which, in this example, is the first cam 131) of the plurality of actuating parts (which, in this example, are the first cam 131 and the second cam 132) actuates the first actuated part (which, in this example, is the first engagement part 111) and the second action (which, in this example, is the belt deviation correction action) in which a second actuating part (which, in this example, is the second cam 132) of the plurality of actuating parts (which, in this example, are the first cam 131 and the second cam 132)

actuates the second actuated part (which, in this example, is the second engagement part 112) can be prevented from affecting each other. Therefore, simply by controlling the single drive source (which, in this example, is the rotary drive source 190), the first action (which, in this example, is the roller press action) on the first actuated part (which, in this example, is the first engagement part 111) by the first actuating part (which, in this example, is the first cam 131) and the second action (which, in this example, is the belt deviation correction action) on the second actuated part (which, in this example, is the second engagement part 112) by the second actuating part (which, in this example, is the second cam 132) can be prevented from affecting each other. This makes it possible to simplify a control configuration for individually actuating the plurality of actuated parts (which, in this example, are the first engagement part 111 and the second engagement part 112).

First to Twelfth Embodiments

Next, first to twelfth embodiments are described below with reference to FIGS. 5 to 17 in addition to FIGS. 1 to 4.

Figure 5:
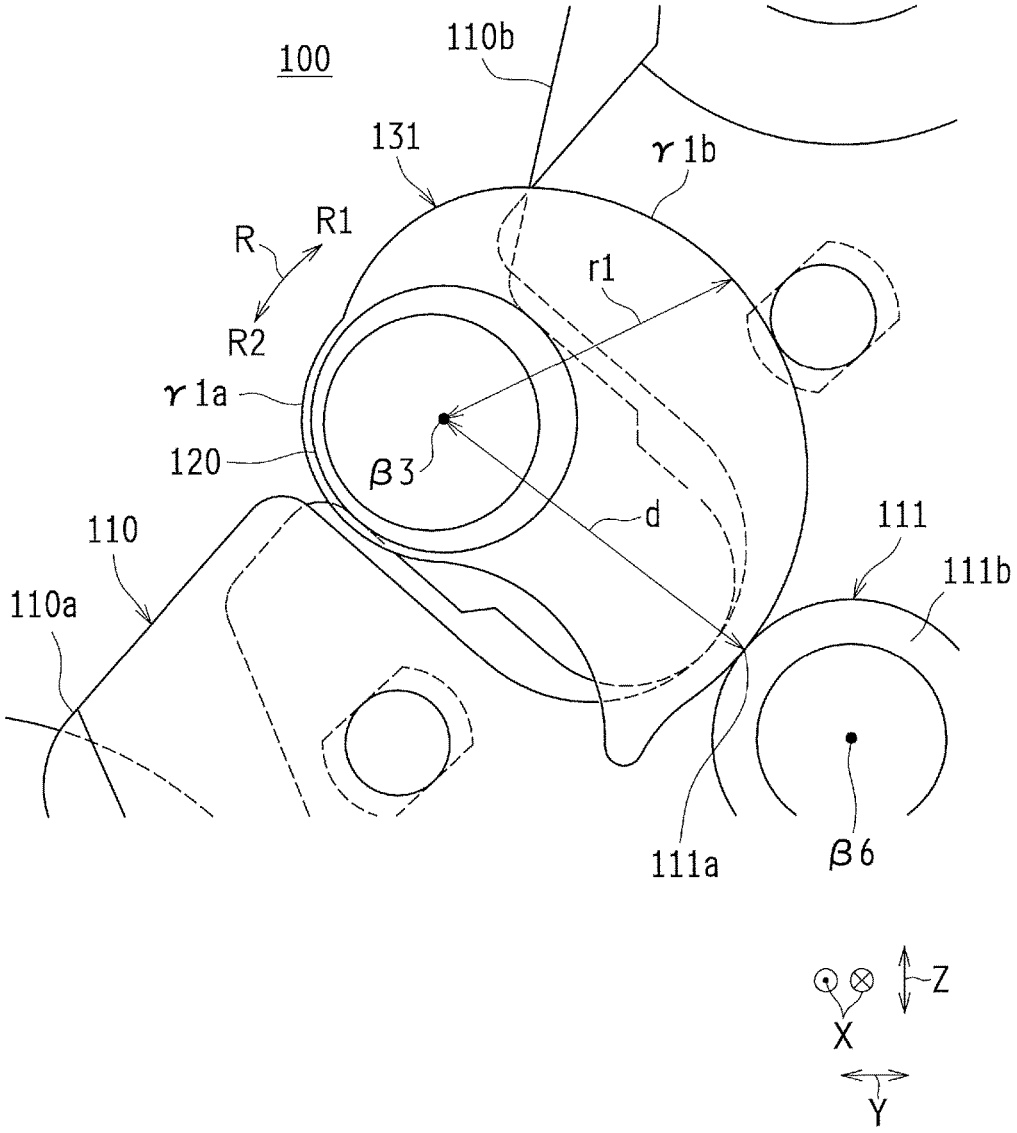
FIG. 5 is a schematic partially-enlarged cross-sectional view showing a first cam and a first engagement part of the drive mechanism shown in FIG. 4.
Figure 6:
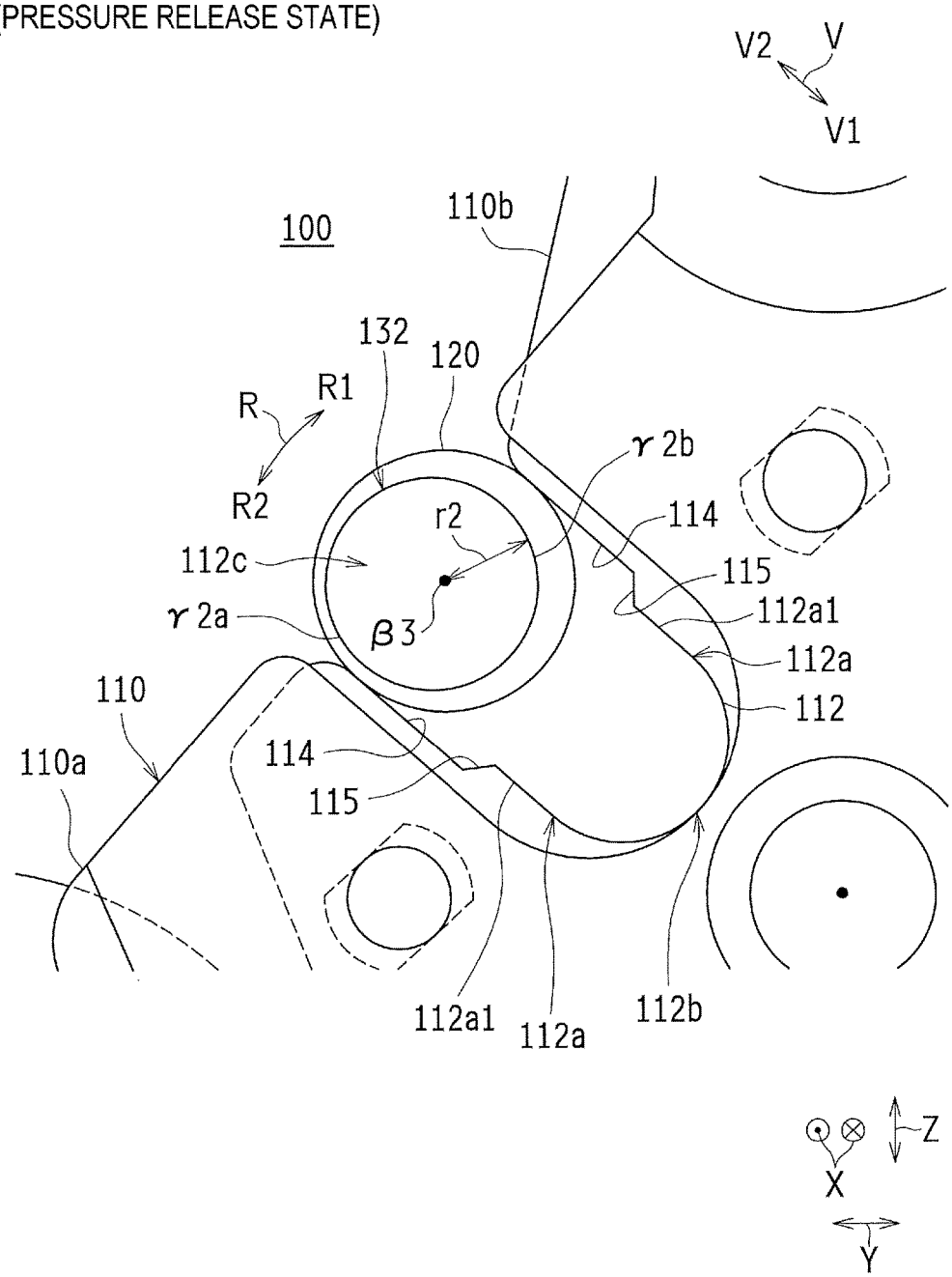
FIG. 6 is a schematic partially-enlarged cross-sectional view showing a second cam and a second engagement part of the drive mechanism shown in FIG. 4.
Figure 7:
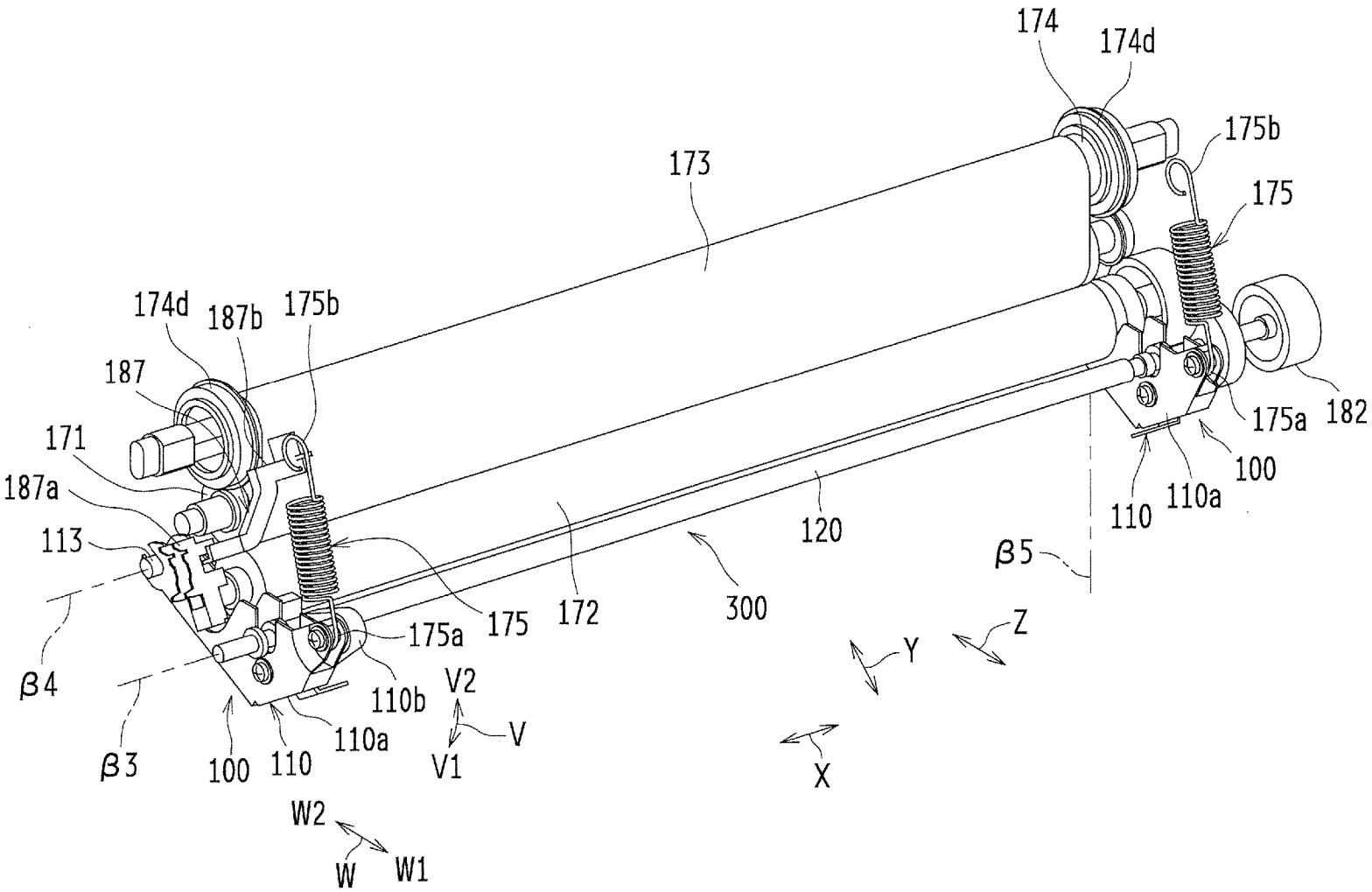
FIG. 7 is a schematic perspective view of the drive mechanism shown in FIG. 4 as seen obliquely from above in the direction of a second side.
Figure 8:
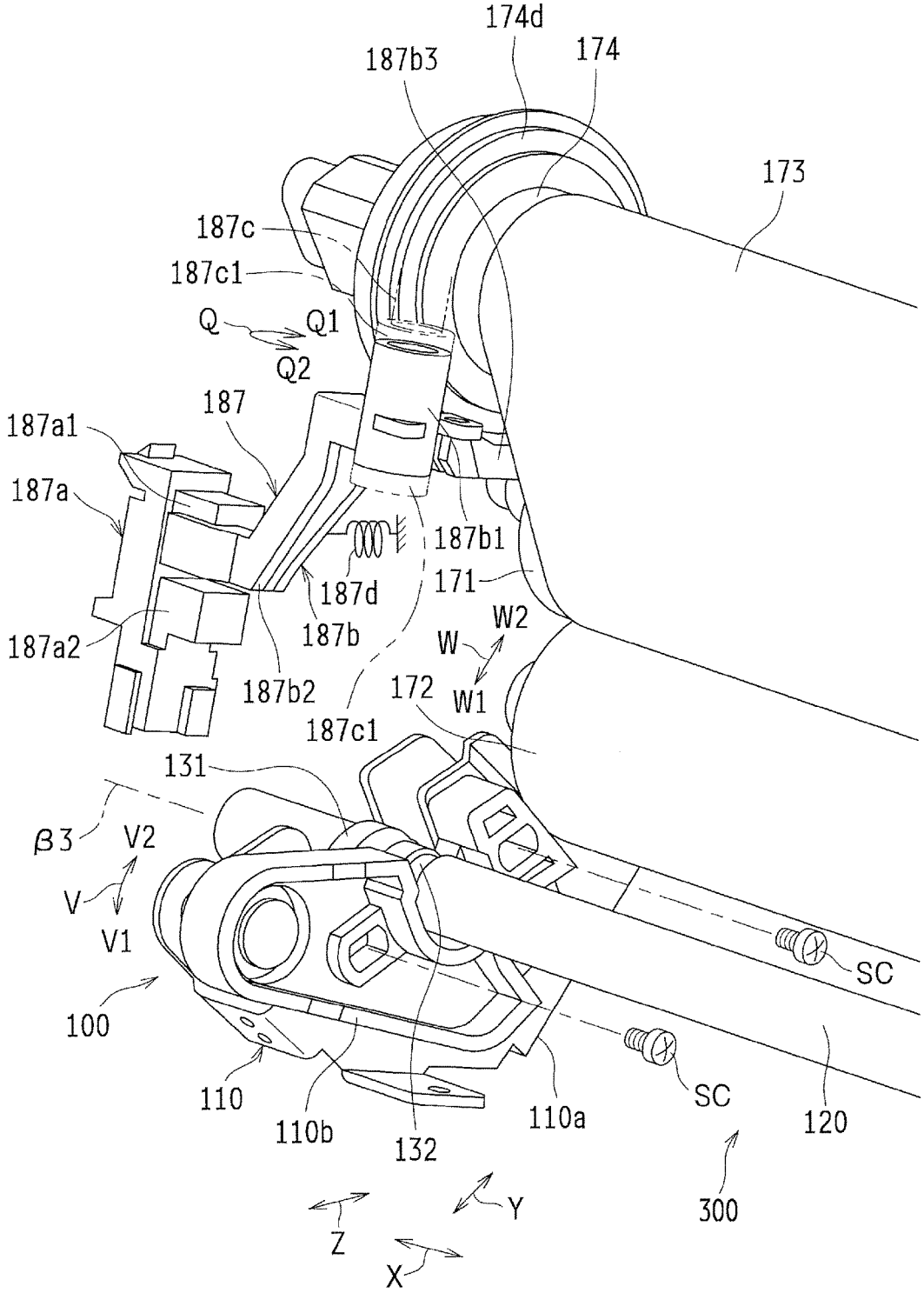
FIG. 8 is a schematic perspective view of a part of the drive mechanism shown in FIG. 4 on a first side in a cross direction as seen obliquely from above in the direction of the first side.

FIG. 5 is a schematic partially-enlarged cross-sectional view showing the first cam 131 and the first engagement part 111 of the drive mechanism 100 shown in FIG. 4. FIG. 6 is a schematic partially-enlarged cross-sectional view showing the second cam 132 and the second engagement part 112 of the drive mechanism 100 shown in FIG. 4. FIG. 7 is a schematic perspective view of the drive mechanism 100 shown in FIG. 4 as seen obliquely from above in the direction of the second side (which, in this example, is the rear side). FIG. 8 is a schematic perspective view of a part of the drive mechanism 100 shown in FIG. 4 on the first side (which, in this example, is the front side) in a cross direction X as seen obliquely from above in the direction of the first side (which, in this example, is the front side).

Figure 9A:
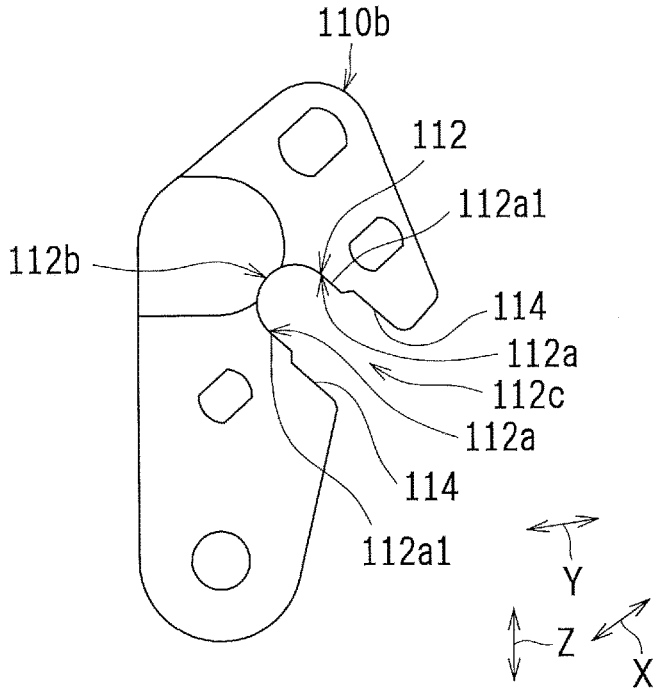
FIGS. 9A and 9B are diagrams showing a removable member constituting an actuated member in the drive mechanism shown in FIG. 4, FIGS. 9A and 9B being schematic front and rear views, respectively, of the removable member constituting the actuated member.
Figure 9B:
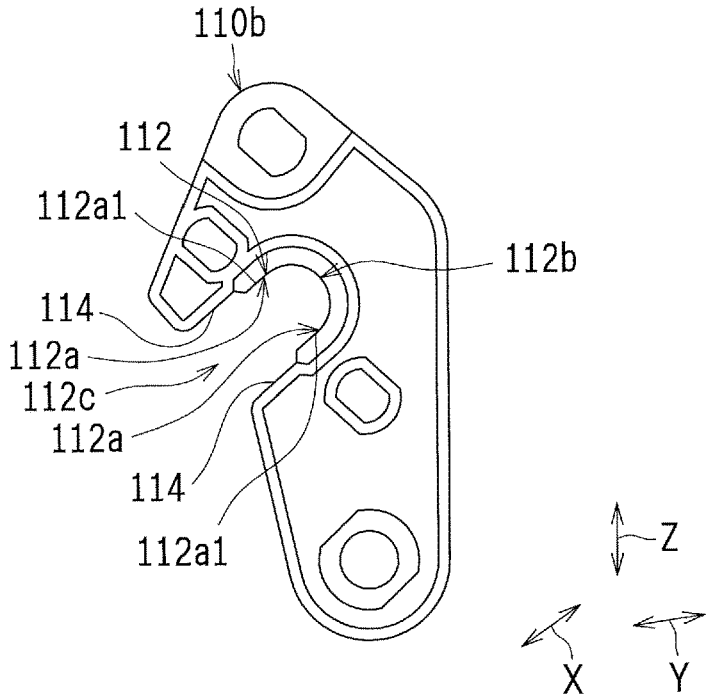

FIGS. 9A and 9B are diagrams showing a removable member 110*b* constituting the actuated member 110 in the drive mechanism 100 shown in FIG. 4. FIGS. 9A and 9B are schematic front and rear views, respectively, of the removable member 110*b* constituting the actuated member 110.

Figure 10:
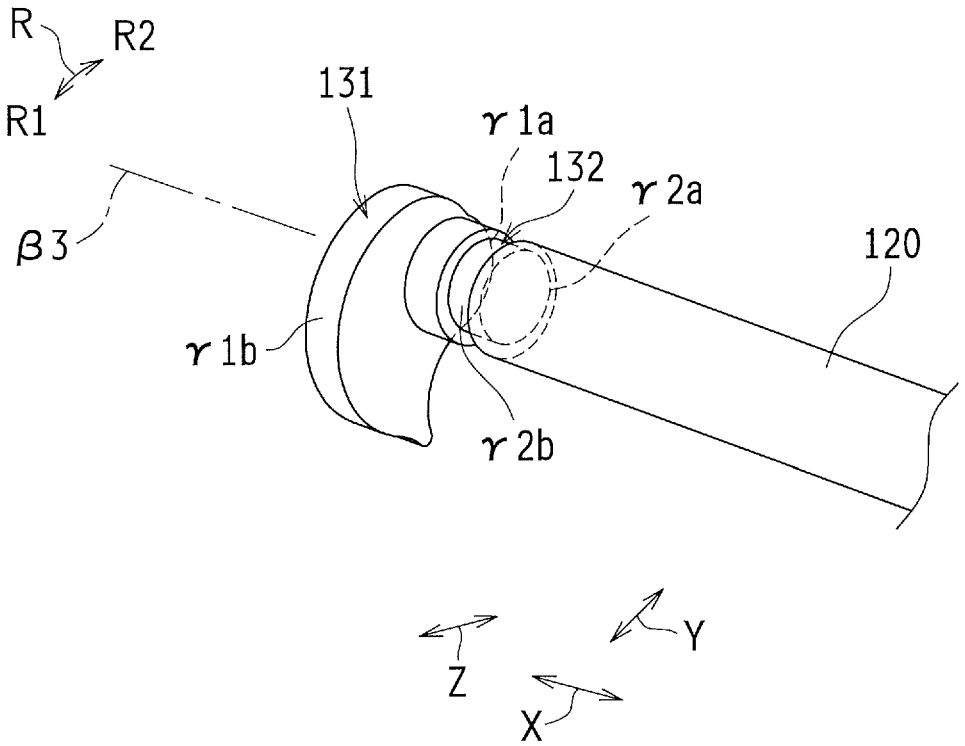
FIG. 10 is a schematic perspective view of the first and second cams provided on a rotary drive shaft on the first side of the drive mechanism shown in FIG. 4 as seen obliquely from above in the direction of the first side.

FIG. 10 is a schematic perspective view of the first and second cams 131 and 132 provided on the rotary drive shaft 120 on the first side of the drive mechanism 100 shown in FIG. 4 as seen obliquely from above in the direction of the first side (which, in this example, is the front side).

Figure 11A:
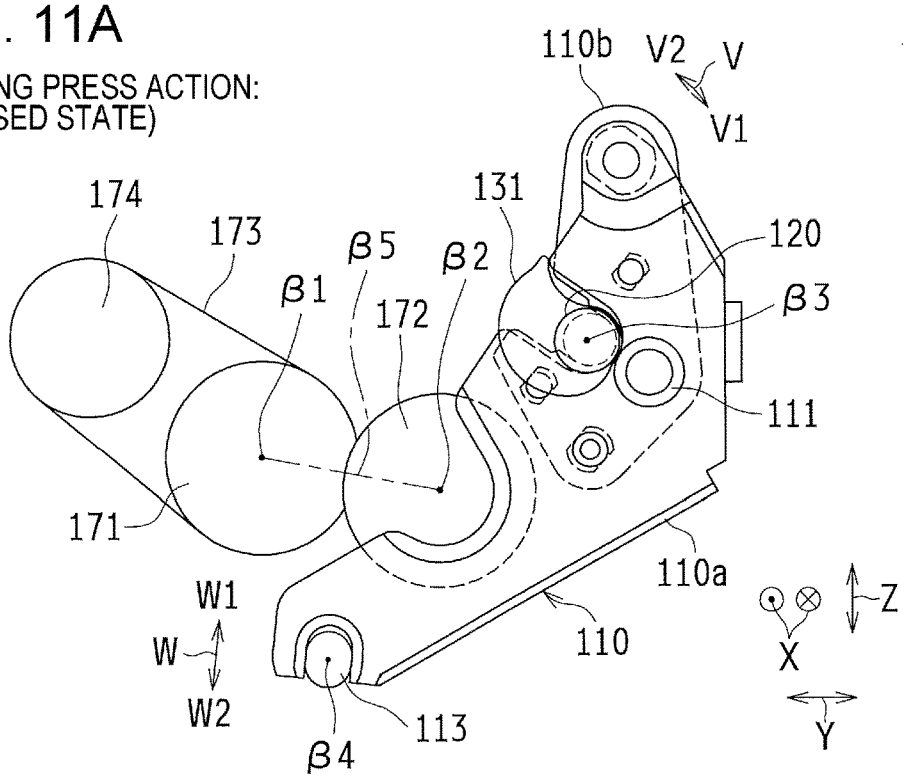
FIGS. 11A and 11B are diagrams showing a state where, in a pressed state of a pressure roller against a fixing roller in the drive mechanism shown in FIG. 4, the first side of the pressure roller is inclined to move in a first direction of swinging directions, FIG. 11A being a schematic partial front view of the first cam and the first engagement part, FIG. 11B being a schematic partial cross-sectional view of the second cam and the second engagement part.
Figure 11B:
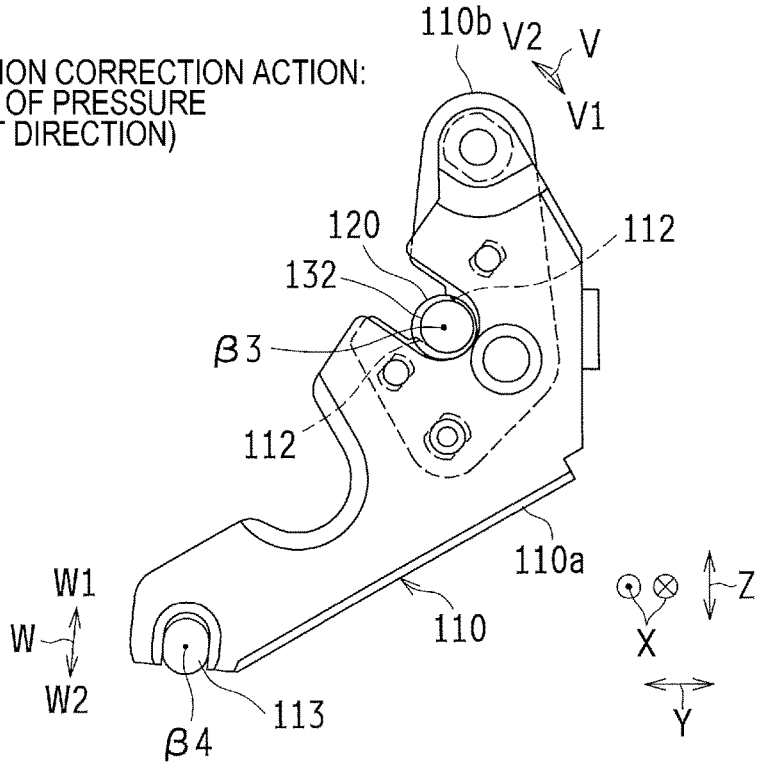
Figure 12A:
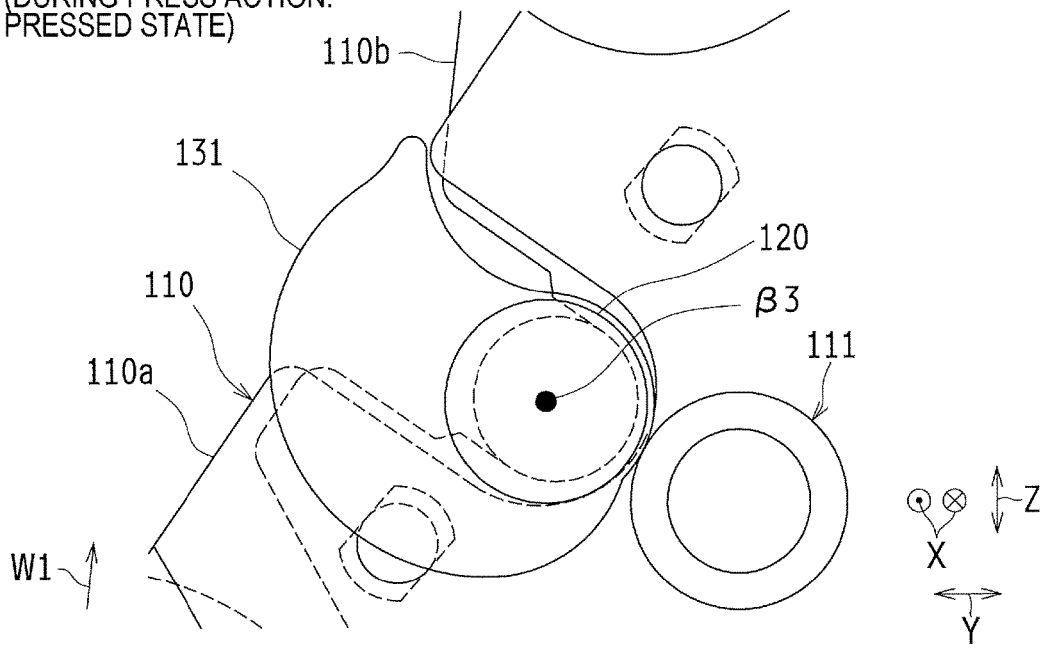
FIGS. 12A and 12B are enlarged views showing an operating state of the drive mechanism shown in FIGS. 11A and 11B, FIG. 12A being a schematic partially-enlarged front view showing the first cam and the first engagement part shown in FIG. 11A, FIG. 12B being a schematic partially-enlarged cross-sectional view showing the second cam and the second engagement part shown in FIG. 11B.
Figure 12B:
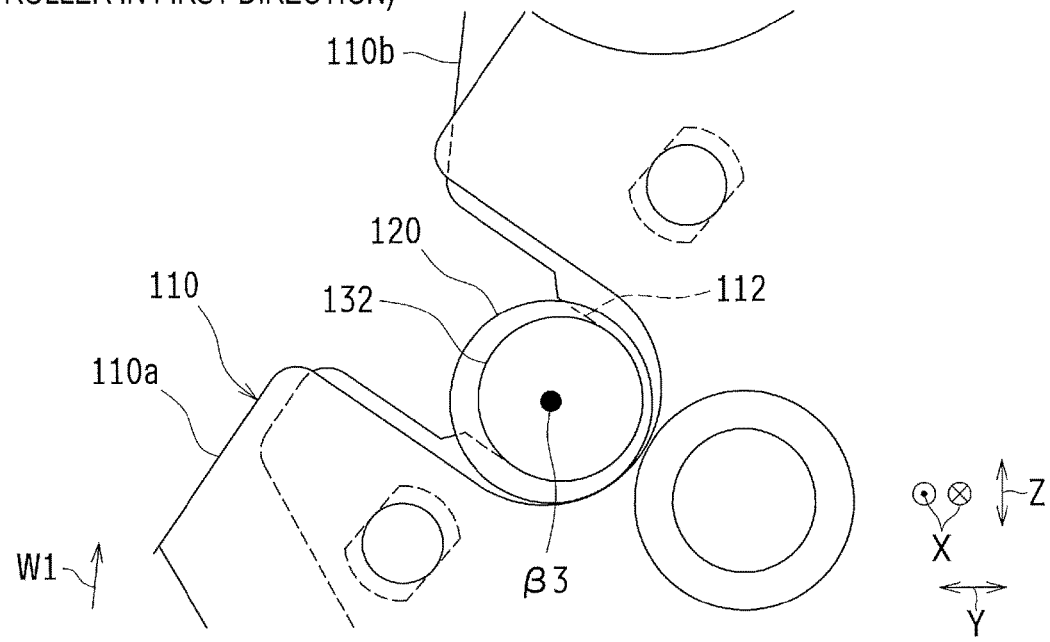

FIGS. 11A and 11B are diagrams showing a state where, in a pressed state of the pressure roller 172 against the fixing roller 171 in the drive mechanism 100 shown in FIG. 4, the first side (which, in this example, is the front side) of the pressure roller 172 is inclined to move in a first direction W1 of the swinging directions W. FIG. 11A is a schematic partial front view of the first cam 131 and the first engagement part 111, and FIG. 11B is a schematic partial cross-sectional view of the second cam 132 and the second engagement part 112. FIGS. 12A and 12B are enlarged views showing an operating state of the drive mechanism 100 shown in FIGS. 11A and 11B. FIG. 12A is a schematic partially-enlarged front view showing the first cam 131 and the first engagement part 111 shown in FIG. 11A, and FIG. 12B is a schematic partially-enlarged cross-sectional view showing the second cam 132 and the second engagement part 112 shown in FIG. 11B.

Figure 13A:
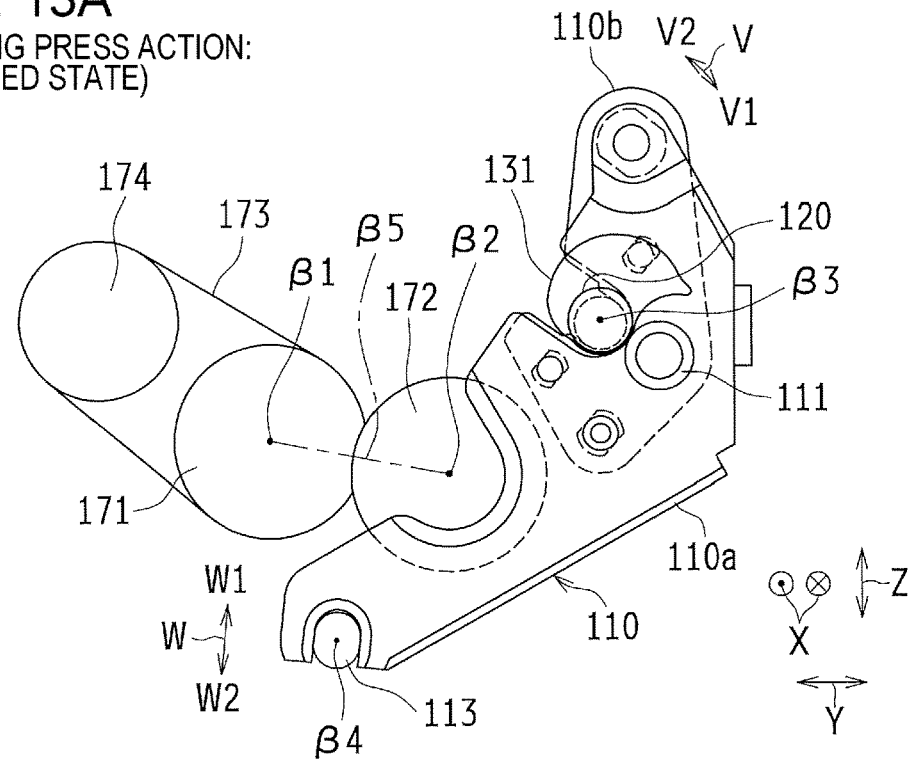
FIGS. 13A and 13B are diagrams showing a state where, in a pressed state of the pressure roller against the fixing roller in the drive mechanism shown in FIG. 4, the first side of the pressure roller is inclined to move in a second direction of the swinging directions, FIG. 13A being a schematic partial front view of the first cam and the first engagement part, FIG. 13B being a schematic partial cross-sectional view of the second cam and the second engagement part.
Figure 13B:
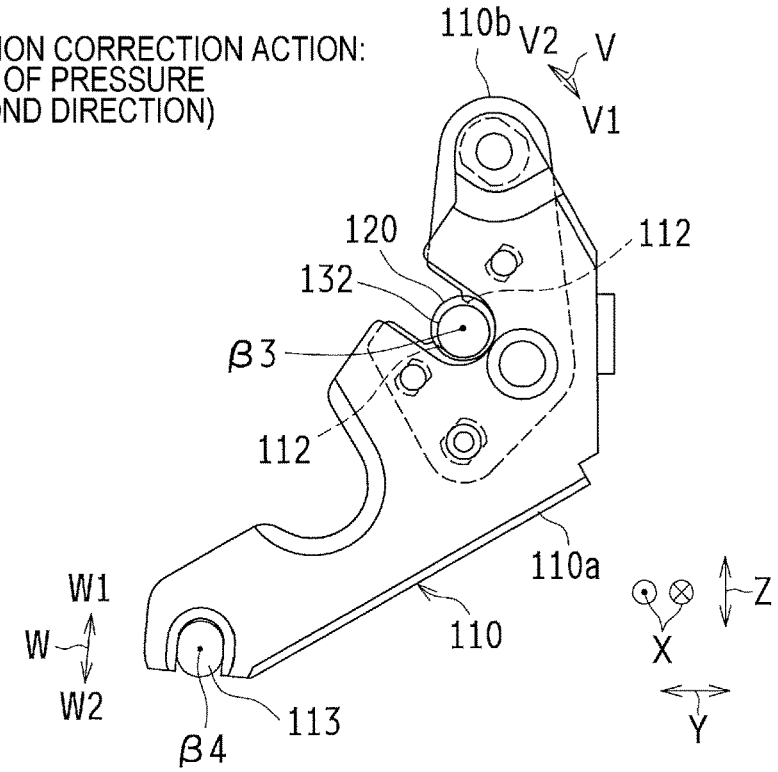
Figure 14A:
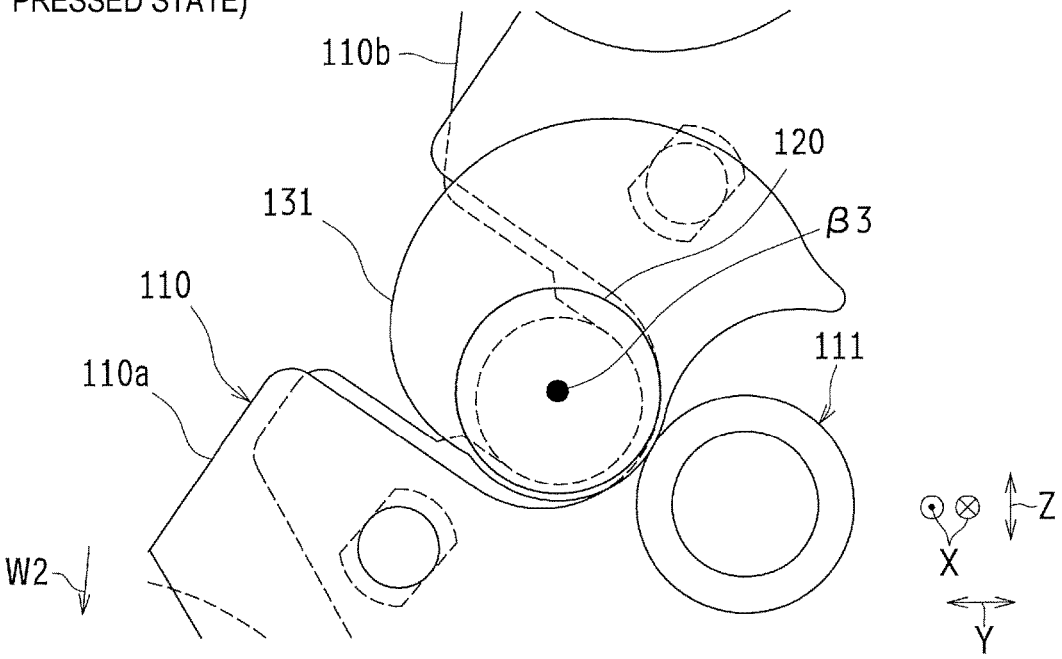
FIGS. 14A and 14B are enlarged views showing an operating state of the drive mechanism shown in FIGS. 13A and 13B, FIG. 14A being a schematic partially-enlarged front view showing the first cam and the first engagement part shown in FIG. 13A, FIG. 14B being a schematic partially-enlarged cross-sectional view showing the second cam and the second engagement part shown in FIG. 13B.
Figure 14B:
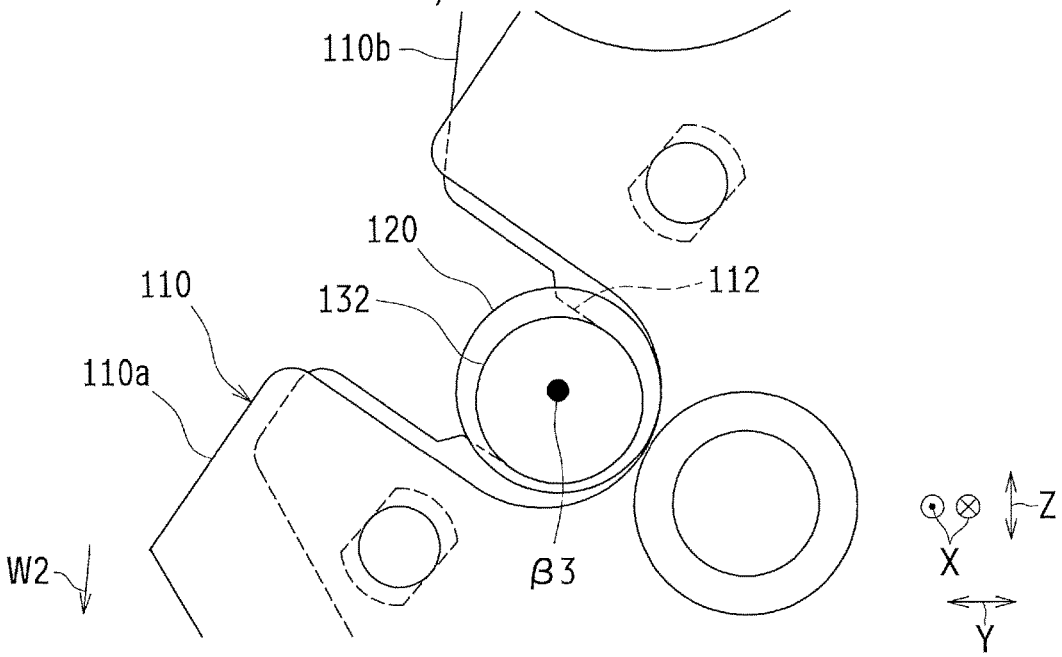

FIGS. 13A and 13B are diagrams showing a state where, in a pressed state of the pressure roller 172 against the fixing roller 171 in the drive mechanism 100 shown in FIG. 4, the first side (which, in this example, is the front side) of the pressure roller 172 is inclined to move in a second direction W2 of the swinging directions W. FIG. 13A is a schematic partial front view of the first cam 131 and the first engagement part 111, and FIG. 13B is a schematic partial cross-sectional view of the second cam 132 and the second engagement part 112. FIGS. 14A and 14B are enlarged views showing an operating state of the drive mechanism 100 shown in FIGS. 13A and 13B. FIG. 14A is a schematic partially-enlarged front view showing the first cam 131 and the first engagement part 111 shown in FIG. 13A, and FIG. 14B is a schematic partially-enlarged cross-sectional view showing the second cam 132 and the second engagement part 112 shown in FIG. 13B.

Figure 15A:
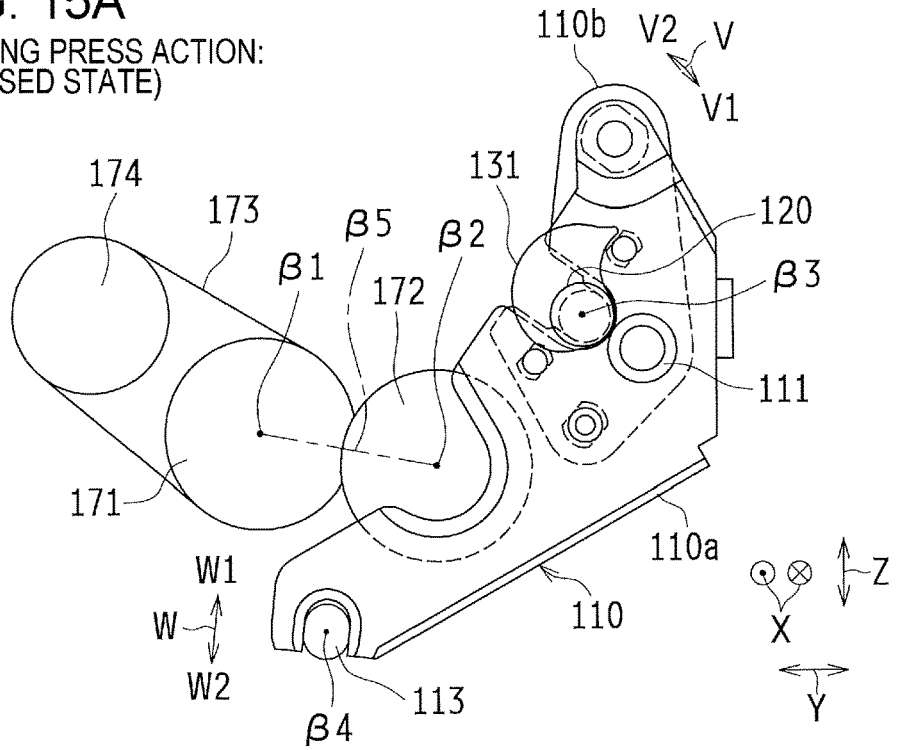
FIGS. 15A and 15B are diagrams showing a state where, in a pressed state of the pressure roller against the fixing roller in the drive mechanism shown in FIG. 4, the pressure roller is parallel to the fixing roller, FIG. 15A being a schematic partial front view of the first cam and the first engagement part, FIG. 15B being a schematic partial cross-sectional view of the second cam and the second engagement part.
Figure 15B:
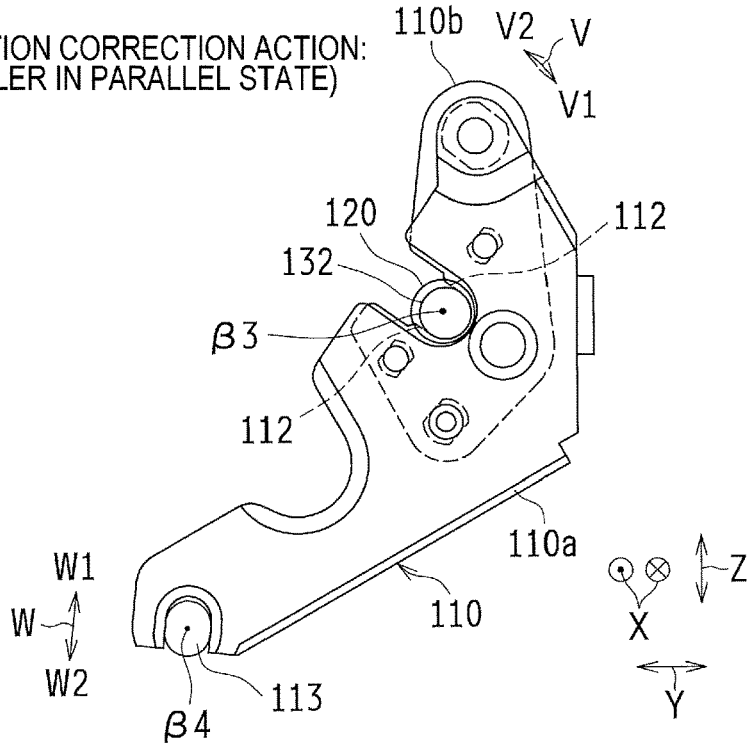
Figure 16A:
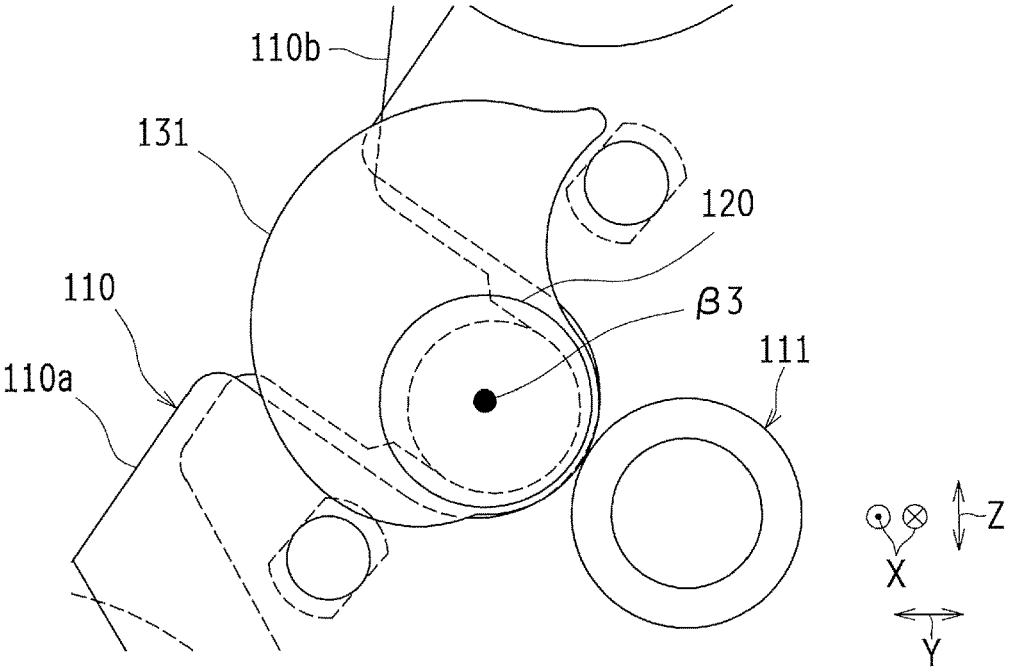
FIGS. 16A and 16B are enlarged views showing an operating state of the drive mechanism shown in FIGS. 15A and 15B, FIG. 16A being a schematic partially-enlarged front view showing the first cam and the first engagement part shown in FIG. 15A, FIG. 16B being a schematic partially-enlarged cross-sectional view showing the second cam and the second engagement part shown in FIG. 15B.
Figure 16B:
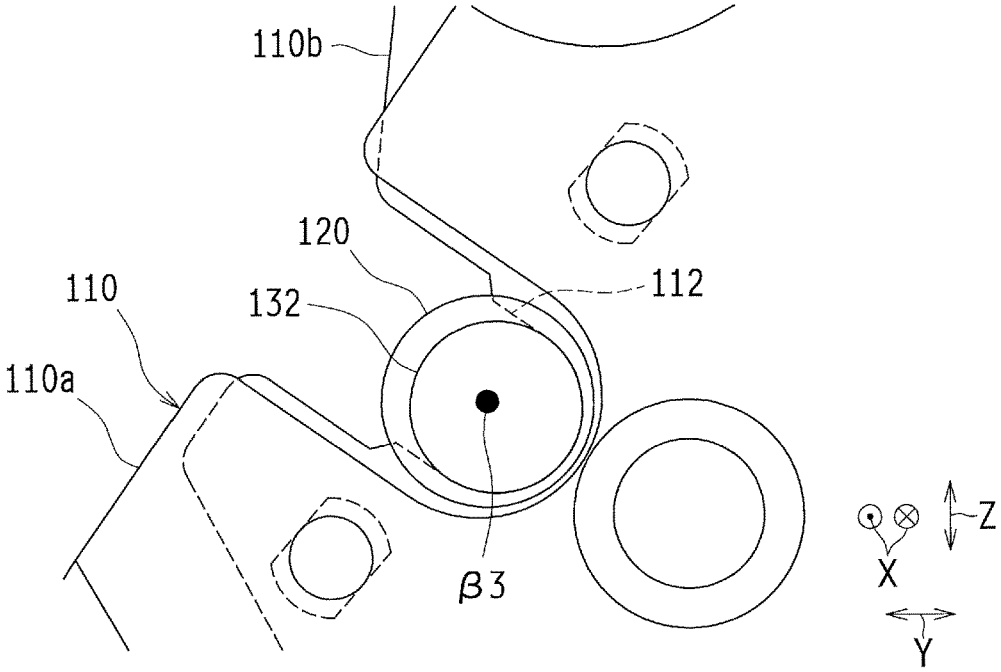

FIGS. 15A and 15B are diagrams showing a state where, in a pressed state of the pressure roller 172 against the fixing roller 171 in the drive mechanism 100 shown in FIG. 4, the pressure roller 172 is parallel to the fixing roller 171. FIG. 15A is a schematic partial front view of the first cam 131 and the first engagement part 111, and FIG. 15B is a schematic partial cross-sectional view of the second cam 132 and the second engagement part 112. FIGS. 16A and 16B are enlarged views showing an operating state of the drive mechanism 100 shown in FIGS. 15A and 15B. FIG. 16A is a schematic partially-enlarged front view showing the first cam 131 and the first engagement part 111 shown in FIG. 15A, and FIG. 16B is a schematic partially-enlarged cross-sectional view showing the second cam 132 and the second engagement part 112 shown in FIG. 15B.

It should be noted that FIGS. 11B, 13B, and 15B omit to illustrate the fixing roller 171, the pressure roller 172, the fixing belt 173, and the like.

Figure 17:
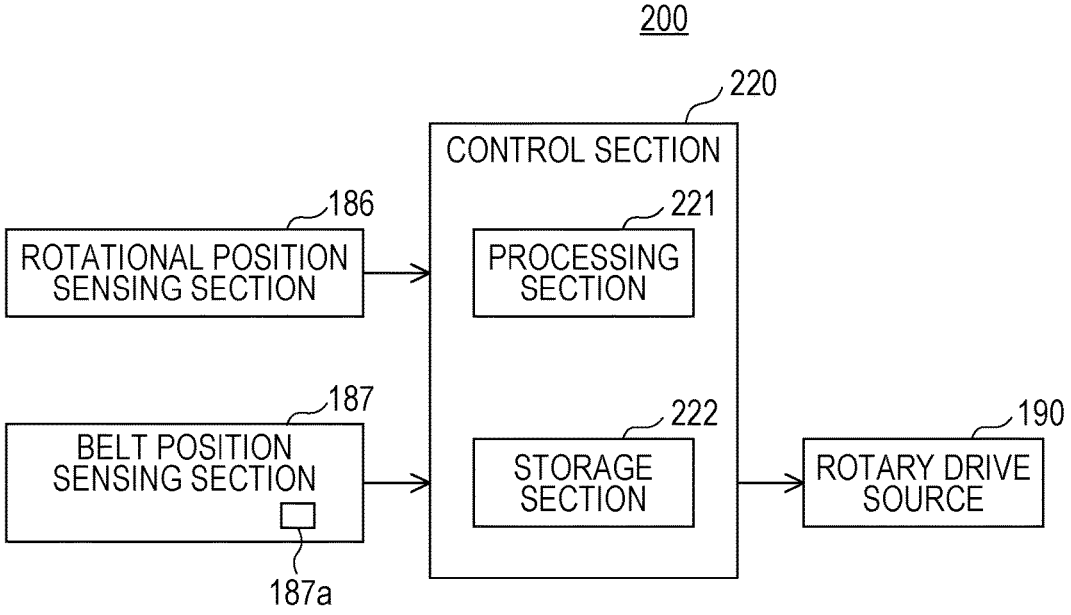
FIG. 17 is a system block diagram schematically showing a configuration of a control system of an image forming apparatus according to the present embodiment.

Further, FIG. 17 is a system block diagram schematically showing a configuration of a control system of the image forming apparatus 200 according to the present embodiment.

First Embodiment

In the present embodiment, the first actuating part (which, in this example, is the first cam 131) of the plurality of actuating parts (which, in this example, are the first cam 131 and the second cam 132) may have an operating state maintenance region γ1*a* in which to maintain an operating state of the corresponding first actuated part (which, in this example, is the first engagement part 111), and the second actuating part (which, in this example, is the second cam 132) may have an operating state change region γ2*b* in which to change an operating state of the corresponding second actuated part (which, in this example, is the second engagement part 112). Moreover, in this configuration, when an operating state of the first action (which, in this example, is the roller press action) on the first actuated part (which, in this example, is the first engagement part 111) is maintained in the operating state maintenance region γ1*a* of the first actuating part (which, in this example, is the first cam 131), an operating state of the second action (which, in this example, is the belt deviation correction action) on the second actuated part (which, in this example, is the second engagement part 112) may be changed in the operating state change region γ2*b* of the second actuating part (which, in this example, is the second cam 132).

This makes it possible to, in actuating the first actuated part (which, in this example, is the first engagement part 111) and the second actuated part (which, in this example, is the second engagement part 112) separately, change the operating state of the second action (which, in this example, is the belt deviation correction action) on the second actuated part (which, in this example, is the second engagement part 112) in the operating state change region γ2*b* of the second actuating part (which, in this example, is the second cam 132) while maintaining the operating state of the first action (which, in this example, is the roller press action) on the first actuated part (which, in this example, is the first engagement part 111) in the operating state maintenance region γ1*a* of the first actuating part (which, in this example, is the first cam 131). This makes it possible, even with a simple configuration in which the first actuating part (which, in this example, is the first cam 131) has the operating state maintenance region γ1*a* and the second actuating part (which, in this example, is the second cam 132) has the operating state change region γ2*b*, to prevent the first action (which, in this example, is the roller press action) and the second action (which, in this example, is the belt deviation correction action) from affecting each other.

It should be noted that, in addition to being configured as just described, the drive mechanism 100 according to the present embodiment may be configured such that the first actuating part (which, in this example, is the first cam 131) of the plurality of actuating parts (which, in this example, are the first cam 131 and the second cam 132) has an operating state change region γ1*b* in which to change the operating state of the corresponding first actuated part (which, in this example, is the first engagement part 111), that the second actuating part (which, in this example, is the second cam 132) has an operating state maintenance region γ2*a* in which to maintain the operating state of the corresponding second actuated part (which, in this example, is the second engagement part 112), and that when the operating state of the second action (which, in this example, is the belt deviation correction action) on the second actuated part (which, in this example, is the second engagement part 112) is maintained in the operating state maintenance region γ2*a* of the second actuating part (which, in this example, is the second cam 132), the operating state of the first action (which, in this example, is the roller press action) on the first actuated part (which, in this example, is the first engagement part 111) is changed in the operating state change region γ1*b* of the first actuating part (which, in this example, is the first cam 131).

This makes it possible to, in actuating the first actuated part (which, in this example, is the first engagement part 111) and the second actuated part (which, in this example, is the second engagement part 112) separately, change the operating state of the first action (which, in this example, is the roller press action) on the first actuated part (which, in this example, is the first engagement part 111) in the operating state change region γ1*b* of the first actuating part (which, in this example, is the first cam 131) while maintaining the operating state of the second action (which, in this example, is the belt deviation correction action) on the second actuated part (which, in this example, is the second engagement part 112) in the operating state maintenance region γ2*a* of the second actuating part (which, in this example, is the second cam 132). This makes it possible, even with a simple configuration in which the first actuating part (which, in this example, is the first cam 131) has the operating state change region γ1*b* and the second actuating part (which, in this example, is the second cam 132) has the operating state maintenance region γ2*a*, to prevent the first action (which, in this example, is the roller press action) and the second action (which, in this example, is the belt deviation correction action) from affecting each other.

Therefore, the first action (which, in this example, is the roller press action) of the first actuating part (which, in this example, is the first cam 131) on the first actuated part (which, in this example, is the first engagement part 111) and the second action (which, in this example, is the belt deviation correction action) of the second actuating part (which, in this example, is the second cam 132) on the second actuated part (which, in this example, is the second engagement part 112) can be alternately performed. That is, when a first operating state is maintained, a second operating state can be changed; in other words, when the second operating state is changed, the first operating state can be maintained. In addition, when the second operating state is maintained, the first operating state can be changed; in other words, when the first operating state is changed, the second operating state can be maintained.

Second Embodiment

The present embodiment may be configured such that when the operating state of the first action (which, in this example, is the roller press action) on the first actuated part (which, in this example, is the first engagement part 111) is changed in the operating state change region γ1*b* of the first actuating part (which, in this example, is the first cam 131), the second action (which, in this example, is the belt deviation correction action) on the second actuated part (which, in this example, is the second engagement part 112) by the second actuating part (which, in this example, is the second cam 132) is not performed.

This makes it possible not to perform the second action (which, in this example, is the belt deviation correction action) on the second actuated part (which, in this example, is the second engagement part 112) by the second actuating part (which, in this example, is the second cam 132) while changing the operating state of the first action (which, in this example, is the roller press action) of the first actuating part (which, in this example, is the first cam 131) on the first actuated part (which, in this example, is the first engagement part 111). This makes it possible, even with a simple configuration in which the first actuating part (which, in this example, is the first cam 131) has the operating state change region γ1*b*, to prevent the first action (which, in this example, is the roller press action) and the second action (which, in this example, is the belt deviation correction action) from affecting each other.

Therefore, in this case, too, the first action (which, in this example, is the roller press action) of the first actuating part (which, in this example, is the first cam 131) on the first actuated part (which, in this example, is the first engagement part 111) and the second action (which, in this example, is the belt deviation correction action) of the second actuating part (which, in this example, is the second cam 132) on the second actuated part (which, in this example, is the second engagement part 112) can be alternately performed. That is, when the first operating state is maintained, the second operating state can be changed; in other words, when the second operating state is changed, the first operating state can be maintained. In addition, when the second operating state is maintained, the first operating state can be changed; in other words, when the first operating state is changed, the second operating state can be maintained.

Third Embodiment

In the present embodiment, the single drive source may be the rotary driver source 190, which outputs rotary drive force, and the single drive part may be the rotary drive shaft 120, to which the rotary drive force from the rotary drive source 190 is transmitted.

At least two actuating parts of the plurality of actuating parts may be constituted by cams (which, in this example, are the first cam 131 and the second cam 132). A first cam (which, in this example, is the first cam 131) and a second cam (which, in this example, is the second cam 132) of the at least two cams may be provided on the rotary drive shaft 120 so that the first action (which, in this example, is the roller press action) in which the first cam (which, in this example, is the first cam 131) actuates the first actuated part (which, in this example, is the first engagement part 111) and the second action (which, in this example, is the belt deviation correction action) in which the second cam (which, in this example, is the second cam 132) actuates the second actuated part (which, in this example, is the second engagement part 112) do not affect each other.

This makes it possible to, in actuating the first actuated part (which, in this example, is the first engagement part 111) and the second actuated part (which, in this example, is the second engagement part 112) separately, drive the first cam (which, in this example, is the first cam 131) and the second cam (which, in this example, is the second cam 132) to rotate on an axis of rotation of the rotary drive shaft 120 with rotary drive force from the rotary drive source 190 in a state where the first action (which, in this example, is the roller press action) by the first cam (which, in this example, is the first cam 131) and the second action (which, in this example, is the belt deviation correction action) by the second cam (which, in this example, is the second cam 132) do not affect each other. This makes it possible, even with a simple configuration in which the first cam (which, in this example, is the first cam 131) and the second cam (which, in this example, is the second cam 132) provided on the rotary drive shaft 120 are used, to prevent the first action (which, in this example, is the roller press action) and the second action (which, in this example, is the belt deviation correction action) from affecting each other.

Fourth Embodiment

In the present embodiment, the first cam (which, in this example, is the first cam 131) and the second cam (which, in this example, is the second cam 132) may be provided on the rotary drive shaft 120 so that a displacement of a diameter r1 of the first cam (which, in this example, is the first cam 131) and a displacement of a diameter (radius r2) of the second cam (which, in this example, is the second cam 132) are not in phase (or are out of phase) with each other.

This makes it possible to, in actuating the first actuated part (which, in this example, is the first engagement part 111) and the second actuated part (which, in this example, is the second engagement part 112) separately, prevent the displacement of the diameter r1 of the first cam (which, in this example, is the first cam 131) and the displacement of the diameter (radius r2) of the second cam (which, in this example, is the second cam 132) from being in phase with each other. This makes it possible to easily achieve a configuration in which the first action (which, in this example, is the roller press action) in which the first cam (which, in this example, is the first cam 131) actuates the first actuated part (which, in this example, is the first engagement part 111) and the second action (which, in this example, is the belt deviation correction action) in which the second cam (which, in this example, is the second cam 132) actuates the second actuated part (which, in this example, is the second engagement part 112) do not affect each other.

Specifically, the first cam (which, in this example, is the first cam 131) and the second cam (which, in this example, is the second cam 132) can be provided on the rotary drive shaft 120 so that the first cam (which, in this example, is the first cam 131) and the second cam (which, in this example, is the second cam 132) are out of phase with each other by a predetermined angle (e.g. 180 degrees) so as to alternate in phase with each other.

Fifth Embodiment

The present embodiment may further include the actuated member 110 (specifically, a supporting member or, in this example, a pressure lever), in which the first actuated part (which, in this example, is the first engagement part 111) and the second actuated part (which, in this example, is the second engagement part 112) are provided. The first cam (which, in this example, is the first cam 131) may cause the actuated member 110 to reciprocate in first directions of reciprocation (which, in this example, are turning directions V) by means of the first actuated part (which, in this example, is the first engagement part 111). The second cam (which, in this example, is the second cam 132) may cause the actuated member 110 to reciprocate in second directions of reciprocation (which, in this example, are the swinging directions W) that are different from the first directions of reciprocation (which, in this example, are the turning directions V) by means of the second actuated part (which, in this example, is the second engagement part 112).

This makes it possible for the first cam (which, in this example, is the first cam 131) to cause the actuated member 110 to reciprocate in the first directions of reciprocation (which, in this example, are the turning directions V) by means of the first actuated part (which, in this example, is the first engagement part 111) and for the second cam (which, in this example, is the second cam 132) to cause the actuated member 110 to reciprocate in the second directions of reciprocation (which, in this example, are the swinging directions W) by means of the second actuated part (which, in this example, is the second engagement part 112). This makes it possible to easily actuate the actuated member 110 with use of the first actuated part (which, in this example, is the first engagement part 111) and the second actuated part (which, in this example, is the second engagement part 112) provided in the actuated member 110.

Sixth Embodiment

In the present embodiment, the first directions of reciprocation may include the turning directions V of turning around an axis of turning β4 that is parallel or substantially parallel to the direction (which, in this example, is the cross direction X) of an axis of rotation β3 of the rotary drive shaft 120. The second directions of reciprocation may include the swinging directions W of swinging around an axis of swinging β5 that intersects (or, specifically, is orthogonal to or substantially orthogonal to) the axis of turning β4. Moreover, the actuated member 110 may be configured to be turnable in the turning directions V and swingable in the swinging directions W.

This makes it possible to turn the actuated member 110 in the turning directions V and swing the actuated member 110 in the swinging directions W. This makes it possible to move the actuated member 110 in a plurality of directions that are different from one another.

Seventh Embodiment

In the present embodiment, the actuated member 110 may include a main body member 110*a* in which the first actuated part (which, in this example, is the first engagement part 111) is provided and the removable member 110*b* (which, in this example, is a swinging guide), removably provided in the main body member 110*a*, in which the second actuated part (which, in this example, is the second engagement part 112) is provided.

This makes it possible to removably provide the removable member 110*b*, in which the second actuated part (which, in this example, is the second engagement part 112) is provided, in the main body member 110*a*, in which the first actuated part (which, in this example, is the first engagement part 111) is provided. This makes it possible to improve the workability of mounting of the rotary drive shaft 120, on which the first cam (which, in this example, is the first cam 131) and the second cam (which, in this example, is the second cam 132) are provided, and the actuated member 110, in which the first actuated part (which, in this example, is the first engagement part 111) and the second actuated part (which, in this example, is the second engagement part 112) are provided.

Eighth Embodiment

In the present embodiment, the actuated member 110 may be a pair of actuated members 110 located on both sides of the rotary drive shaft 120 in the direction of the axis of rotation β3.

Incidentally, in a case where the actuated member 110 includes a pair of actuated members 110 located on both sides of the rotary drive shaft 120 in the direction of the axis of rotation β3, using a single cam as the first cam makes it difficult to certainly cause the pair of actuated members 110 to reciprocate in the same direction of the first directions of reciprocation (which, in this example, are the turning directions V).

In this respect, in the present embodiment, the first cam (which, in this example, is the first cam 131) may be a pair of first cams (which, in this example, is a pair of first cams 131) provided on both sides of the rotary drive shaft 120 in the direction of the axis of rotation β3 and be configured to cause the pair of actuated members 110 to reciprocate in the same direction of the first directions of reciprocation (which, in this example, are the turning directions V) when the rotary drive shaft 120 is driven to rotate on the axis of rotation β3.

This makes it possible, with the pair of first cams 131 provided as the first cam on both sides of the rotary drive shaft 120 in the direction of the axis of rotation β3, to certainly cause the pair of actuated members 110 to reciprocate in the same direction of the first directions of reciprocation (which, in this example, are the turning directions V) when the rotary drive shaft 120 is driven to rotate on the axis of rotation β3. This makes it possible to certainly cause the first actuated parts (which, in this example, are the first engagement parts 111) of the pair of actuated members 110 to operate in the same direction of the first directions of reciprocation (which, in this example, are the turning directions V) on both sides of the rotary drive shaft 120 in the direction of the axis of rotation β3. In this case, those parts of the pair of actuated members 110 which at least come into contact with the first actuated parts (which, in this example, are the first engagement parts 111) may be identical or substantially identical in shape to each other, the pair of first cams 131 may be identical or substantially identical in shape to each other, and the displacements of the diameters r1 of the pair of first cams 131 may be identical or substantially identical in phase to each other.

Ninth Embodiment

Incidentally, in a case where the actuated member 110 includes a pair of actuated members 110 located on both sides of the rotary drive shaft 120 in the direction of the axis of rotation β3, it is possible to use a single cam or a pair of cams as the second cam.

In the present embodiment, the second cam may be a single second cam 132 provided on one side (which, in this example, is the front side) of the rotary drive shaft 120 in the direction of the axis of rotation β3. The second cam may be configured to cause that one (which, in this example, is a front one) of the pair of actuated members 110 on which the single second cam 132 is provided to reciprocate in the second directions of reciprocation (which, in this example, are the swinging directions W).

This makes it possible that even when the single second cam 132 provided on one side (which, in this example, is the front side) of the rotary drive shaft 120 in the direction of the axis of rotation β3 is used as the second cam, the single second cam 132 certainly causes that one (which, in this example, is the front one) of the pair of actuated members 110 on which the single second cam 132 is provided to reciprocate in the second directions of reciprocation (which, in this example, are the swinging directions W). This makes it possible to cause the second actuated part (which, in this example, is the second engagement part 112) of the actuated member 110 to operate without a hindrance in the second directions of reciprocation (which, in this example, are the swinging directions W) on one side (which, in this example, is the front side) of the rotary drive shaft 120 in the direction of the axis of rotation β3.

Tenth Embodiment

Note here that, although not illustrated, the present embodiment may be configured such that the second cam includes a pair of second cams 132 provided on both sides of the rotary drive shaft 120 in the direction of the axis of rotation β3 and is configured to cause the pair of actuated members 110 to reciprocate in opposite directions W1 and W2 of the second directions of reciprocation (which, in this example, are the swinging directions W) when the rotary drive shaft 120 is driven to rotate on the axis of rotation β3. In other words, a first second cam 132 of the pair of second cams 132 causes a first actuated member 110 of the pair of actuated members 110 to move in the first direction W1 of the second directions of reciprocation (which, in this example, are the swinging directions W), and a second cam 132 of the pair of second cams 132 causes a second actuated member 110 of the pair of actuated members 110 to move in a second direction W2 of the second directions of reciprocation (which, in this example, are the swinging directions W); meanwhile, the first second cam 132 causes the first actuated member 110 to move in the second direction W2 of the second directions of reciprocation (which, in this example, are the swinging directions W), and the second cam 132 causes the second actuated member 110 to move in the first direction W1 of the second directions of reciprocation (which, in this example, are the swinging directions W).

This makes it possible, with the pair of second cams 132 provided as the second cam on both sides of the rotary drive shaft 120 in the direction of the axis of rotation β3, to certainly cause the pair of actuated members 110 to reciprocate in opposite directions W1 and W2 of the second directions of reciprocation (which, in this example, are the swinging directions W) when the rotary drive shaft 120 is driven to rotate on the axis of rotation β3. This makes it possible to certainly cause the second actuated parts (which, in this example, are the second engagement parts 112) of the pair of actuated members 110 to operate in opposite directions of the second directions of reciprocation (which, in this example, are the swinging directions W) on both sides of the rotary drive shaft 120 in the direction of the axis of rotation β3. In this case, those parts of the pair of actuated members 110 which at least come into contact with the second actuated parts (which, in this example, are the second engagement parts 112) may be identical or substantially identical in shape to each other, the pair of second cams 132 may be identical or substantially identical in shape to each other, and the displacements of the diameters of the pair of second cams 132 may be identical or substantially identical in phase to each other.

Eleventh Embodiment

The present embodiment may be configured such that the first actuating part (which, in this example, is the first cam 131) of the plurality of actuating parts (which, in this example, are the first cam 131 and the second cam 132) performs the roller press action of pressing the second roller (which, in this example, is the pressure roller 172) against the first roller (which, in this example, is the fixing roller 171) and the second actuating part (which, in this example, is the second cam 132) performs a conveyed body deviation correction action (which, in this example, is the belt deviation correction action) of correcting a deviation of the conveyed body (which, in this example, is the fixing belt 173).

This makes it possible to prevent the first action, which is the roller press action of pressing the second roller (which, in this example, is the pressure roller 172) against the first roller (which, in this example, is the fixing roller 171), and the second action, which is the conveyed body deviation correction action (which, in this example, is the belt deviation correction action) of correcting a deviation of the conveyed body (which, in this example, is the fixing belt 173), from affecting each other. This makes it possible to achieve both the roller press action as the first action and the deviation correction action as the second action simply by controlling the single drive source (which, in this example, is the rotary drive source 190).

Twelfth Embodiment

In the present embodiment, the conveyed body is an endless belt that is wound around the first roller (which, in this example, is the fixing roller 171) and the third roller (which, in this example, is the heating roller 174).

This makes it possible suitably perform both the roller press action and a deviation correction of the endless belt (which, in this example, is the fixing belt 173).

Detailed Configuration of Drive Mechanism

Next, a detailed configuration of the drive mechanism 100 according to the present embodiment is described below in more concrete terms.

The drive mechanism 100 is configured such that the fixing roller 171 and the pressure roller 172, which face each other, clamp and convey the fixing belt 173 while rotating each other in a state where the pressure roller 172 is pressed against the fixing roller 171.

The drive mechanism 100 includes the actuated member 110, which supports the second roller (which, in this example, is the pressure roller 172) of the fixing roller 171 and the pressure roller 172 so that the pressure roller 172 is rotatable on an axis with respect to the first roller (which, in this example, is the fixing roller 171) and the pressure roller 172 is movable in such a first direction V1 as to move the axes of rotation β1 and β2 of the fixing roller 171 and the pressure roller 172 away from each other and in such a second direction V2 as to move the axes of rotation β1 and β2 of the fixing roller 171 and the pressure roller 172 close to each other.

The actuated member 110 is supported to be turnable on the axis of turning β4, which is parallel or substantially parallel to the axis of rotation β2 of the second roller (which, in this example, is the pressure roller 172), with respect to the first roller (which, in this example, is the fixing roller 171).

In this example, the actuated member 110 supports the pressure roller 172 so that the pressure roller 172 turns in the first direction V1 and the second direction V2 with respect to the fixing roller 171. The drive mechanism 100 is configured to press the pressure roller 172 against the fixing roller 171 by means of the biasing member 175 via the actuated member 110, adjust the pressure, and release the pressing of the pressure roller 172 against the fixing roller 171 via the actuated member 110.

The actuated member 110 rotatably supports the rotating shaft 172*a* of the pressure roller 172 and is provided to be turnable on the axis of turning β4 of a turning spindle 113 (specifically, a turning pin) that is parallel or substantially parallel to the rotating shaft 172*a* of the pressure roller 172.

The actuated member 110 includes a pair of actuated members 110 (which, in this example, are actuated plates or, specifically, supporting plates) provided along a direction orthogonal or substantially orthogonal to the rotating shaft 172*a* of the pressure roller 172 on the outside of both ends of the pressure roller 172 in the cross direction X.

The pair of actuated members 110 have recesses 110*c* on sides thereof that face both rotating shafts 172*a* of the pressure roller 172, and rotatably support both rotating shafts 172*a* of the pressure roller 172 via the bearings 110*d* in the recesses 110*c*.

The pair of actuated members 110 have long through-holes 110*e* provided in an area (which, in the example shown in FIG. 4, is the diagonally downward left side of the pressure roller 172) surrounding the pressure roller 172 between the axis of rotation β1 of the fixing roller 171 and the axis of rotation β2 of the pressure roller 172 and bored along the direction of the axis of turning β4.

The long through-holes 110*e* extend in the swinging directions W or substantially in the swinging directions W. The turning spindle 113 is rotatably supported on the main body (specifically, the main body frame FL) of the fixing device 17. The long through-holes 110*e* are locked about the turning spindle 113 to be movable along the swinging directions W. This makes it possible to configure the pair of actuated members 110 to be turnable in the turning directions V and swingable in the swinging directions W.

Note here that the swinging directions W are directions around the axis of swinging β5 that is orthogonal to or substantially orthogonal to the axis of turning β4 and, in this example, the axis of swinging β5 is an axis that is orthogonal to or substantially orthogonal to the axis of turning β4 and passes through the axis of rotation of β1 of the fixing roller 171 or the vicinity thereof and the axis of rotation of β2 of the pressure roller 172 or the vicinity thereof (more specifically, an axis located at a one-side end, the center, or substantially the center [in this example, a rear-side end] of the pressure roller 172 along the axis of rotation of (32). This makes it possible to swing the pressure roller 172 in directions of twist with respect to the fixing roller 171. It should be noted that the swinging directions W may be directions of swinging around an axis of swinging that passes through the axis of rotation of β2 or the vicinity thereof and is orthogonal to or substantially orthogonal to both the axis of swinging β5 and the axis of rotation of β2 (more specifically, an axis located at a one-side end, the center, or substantially the center of the pressure roller 172 along the axis of rotation of (32). In this case, the pressure roller 172 swings so as to apply different fixing pressures to the fixing roller 171 on the first side (which, in this example, is the front side) and the second side (which, in this example, is the rear side) of the pressure roller 172 along the axis of rotation of β2; however, since the amount of inclination of the pressure roller 172 is very small, the level of deterioration of fixability is acceptable. Further, in either case, considering that the drive transmission mechanism 180 is provided on a one-side end (which, in this example, is a rear-side end) of the fixing roller 171 along the axis of rotation β1 in order to receive drive from the one-side end of the fixing roller 171 along the axis of rotation β1, it is effective for the axis of swinging β5 to be located on the side end (which, in this example, is the rear-side end) of the pressure roller 172 on which the drive transmission mechanism 180 is provided.

Further, the long through-holes 110*e* further have openings 110*e*1 opening outward (in this example, downward). This makes it possible to simply and easily attach/detach the pair of actuated members 110 to/from the turning spindle 113 and improve the workability of mounting of the pair of actuated members 110 onto the turning spindle 113.

Specifically, the long through-holes 110*e* have U shapes (which, in this example, are U shapes as seen from the front) whose ends opposite to the pressure roller 172 open. The turning spindle 113 has a shape (which, in this example, is an oval shape) that conforms to the long through-holes 110*e*.

The pair of actuated members 110 (which, in this example, are the main body member 110*a* and the removable member 110*b*) have long through-holes 110*f* provided in positions corresponding to the rotary drive shaft 120 and bored along the direction of the axis of rotation β3.

The long through-holes 110*f* extend in the turning directions V or substantially in the turning directions V. Through the long through-holes 110*f*, the rotary drive shaft 120 is inserted. This allows the rotary drive shaft 120 to reciprocate in the turning directions V or substantially in the turning directions V.

Further, the long through-holes 110*f* further have openings 110*f*1 opening outward (in this example, upward). This makes it possible to simply and easily attach/detach the rotary drive shaft 120 to/from the long through-holes 110*f* and improve the workability of mounting of the rotary drive shaft 120 into the long through-holes 110*f*.

Specifically, the long through-holes 110*f* have U shapes (which, in this example, are U shapes as seen from the front) whose ends opposite to the first engagement parts 111 open.

Further, the pair of actuated members 110 have locking parts 110*g* (specifically, mounting bosses) at ends (which, in the example shown in FIG. 4, the diagonally upward right sides of the pressure roller 172) thereof opposite to the turning spindle 113 with the pressure roller 172 interposed therebetween. The pair of biasing members 175 have first ends 175*a* locked about the locking parts 110*g* and second ends 175*b* locked about locking parts FLa of the main body (specifically, the main body frames FL) of the fixing device 17.

The removable member 110*b* provided in a first one (which, in this example, is a front one) of the pair of actuated members 110 is fastened by fastening members SC such as screws to both inner sides of the main body member 110*a*.

First Cam and First Engagement Part

The pair of first cams 131 are provided at both ends of the rotary drive shaft 120 in the direction of the axis of rotation β3. The operating state maintenance regions γ1*a* of the pair of first cams 131 are regions in which the diameters r1 become constant or substantially constant in a circumferential direction of the pair of first cams 131. The operating state change regions γ1*b* of the pair of first cams 131 are regions in which the diameters r1 become gradually larger or smaller in the circumferential direction of the pair of first cams 131.

The first engagement parts 111 have contact parts 111*a* that come into contact with the pair of first cams 131, respectively. In this example, the first engagement parts 111 have circular columnar shapes (which, in this example, are circular shapes as seen from the front). The first engagement parts 111 come into contact with the pair of first cams 131 at the contact parts 111*a* on the outer circumferential surfaces of the circular columnar shapes.

Specifically, the pair of first cams 131 are separate from the rotary drive shaft 120 and is fastened to the rotary drive shaft 120. The first engagement parts 111 have outer rings 111*b* constituting ball bearings that rotate on an axis of rotation β6 that is parallel or substantially parallel to the rotation of axis β3 of the rotary drive shaft 120.

The first engagement parts 111 are provided in such positions in the main body members 110*a* of the pair of actuated members 110 that the pressure roller 172 is brought into a pressed state against the fixing roller 171 in positions in the operating state maintenance regions γ1*a* of the pair of first cams 131 where the first engagement parts 111 are actuated, respectively. Note here that the pressed state is a state of reference fixing pressure serving as a reference (which, in this example, is a state of maximum rated pressure at which a normal sheet such as normal paper is fixed). In addition, the first engagement parts 111 are provided in such positions in the main body members 110*a* of the pair of actuated members 110 that the pressure roller 172 is brought into a pressure adjustment state and/or a pressure release state against the fixing roller 171 in positions in the operating state change regions γ1*b* of the pair of first cams 131 where the first engagement parts 111 are actuated, respectively. Note here that the pressure adjustment state is a state of low fixing pressure adjusted to be lower than the reference fixing pressure (which, in this example, is a state of minimum rated pressure at which a thick sheet such as an envelope or thick paper is fixed) and the pressure release state is a state where no pressure is being applied from the pressure roller 172 toward the fixing roller 171 by the biasing members 175.

It should be noted that, from the point of view of avoiding inconveniences such as deformation or the like of the fixing roller 171 and/or the pressure roller 172, the drive mechanism 100 is in the pressure release state at the time of factory shipment or when no image is being formed.

The first cams 131 are configured to make the fixing pressure of the pressure roller 172 against the fixing roller 171 the reference fixing pressure in the positions in the operating state maintenance regions γ1*a* where the first engagement parts 111 are actuated.

Specifically, the first cams 131 are configured such that, in the positions in the operating state maintenance regions γ1*a* of the pair of first cams 131 where the first engagement parts 111 are actuated, the distance d between the contact parts 111*a* of the first engagement parts 111 with the pair of first cams 131 and the axis of rotation 03 of the rotary drive shaft 120 is maintained at a predetermined first constant distance (e.g. a minimum distance) even when the pair of first cams 131 are rotated in a first direction R1 and a second direction R2 of directions of rotation R. This makes it possible to maintain the pressed state of the pressure roller 172 against the fixing roller 171.

Further, the first cams 131 are configured to adjust the fixing pressure of the pressure roller 172 against the fixing roller 171 in the positions in the operating state maintenance regions γ1*a* where the first engagement parts 111 are actuated.

Specifically, the first cams 131 are configured such that the distance d between the contact parts 111*a* of the first engagement parts 111 with the pair of first cams 131 and the axis of rotation β3 of the rotary drive shaft 120 is made a variable distance (e.g. a distance that is longer than the minimum distance and shorter than a maximum distance) by rotating the pair of first cams 131 in the first direction R1 of the directions of rotation R from the positions in the operating state maintenance regions γ1*a* of the pair of first cams 131 where the first engagement parts 111 are actuated toward the positions in the operating state change regions γ1*b* where the first engagement parts 111 are actuated. This makes it possible to bring the pressure roller 172 into the pressure adjustment state against the fixing roller 171.

Further, the first cams 131 are configured to release the fixing pressure of the pressure roller 172 against the fixing roller 171 in the positions in the operating state change regions γ1*b* where the first engagement parts 111 are actuated.

Specifically, the first cams 131 are configured such that the distance d between the contact parts 111*a* of the first engagement parts 111 with the pair of first cams 131 and the axis of rotation β3 of the rotary drive shaft 120 is made a predetermined second constant distance (e.g. the maximum distance) that is longer than the first constant distance by rotating the pair of first cams 131 in the first direction R1 of the directions of rotation R from the positions in the operating state maintenance regions γ1*a* of the pair of first cams 131 where the first engagement parts 111 are actuated toward the positions in the operating state change regions γ1*b* where the first engagement parts 111 are actuated. This makes it possible to bring the pressure roller 172 into the pressure release state against the fixing roller 171.

In this example, the first cams 131 are configured to adjust the fixing pressure of the pressure roller 172 against the fixing roller to a stepless set pressure. Note, however, that the first cams 131 is not limited to this configuration but may be configured to adjust the fixing pressure of the pressure roller 172 against the fixing roller 171 to one or more steps of set pressure.

Second Cam and Second Engagement Part

The second cam 132 is provided at one end (which, in this example, is a front end) of the rotary drive shaft 120 in the direction of the axis of rotation β3. The operating state change region γ2*b* of the second cam 132 is a region in which the diameter (radius r2) becomes gradually larger or smaller in a circumferential direction of the second cam 132. The operating state maintenance region γ2*a* of the second cam 132 is a region in which the diameter (radius r2) becomes constant or substantially constant in the circumferential direction of the second cam 132.

The second engagement part 112 has contact parts 112*a* that come into contact with the second cam 132. In this example, the second engagement part 112 has a curved part 112*b* (specifically, a U-shaped groove as seen from the front) that is curved substantially half around along the circumferential direction of the second cam 132. The second engagement part 112 comes into contact with the second cam 132 at the contact parts 112*a* on the inner circumferential surface of the curved part 112*b*. The size of the second engagement part 112 between the opposed contact parts 112*a* is a size that is slightly larger than the diameter of the second cam 132 (i.e. such a size that the second cam 132 can be smoothly inserted through the second engagement part 112).

The contact parts 112*a* have extended parts 112*a*1 extended along the turning directions V or substantially along the turning directions V. This allows the second engagement part 112 to certainly bring the second cam 132 into contact at the contact parts 112*a*.

Further, the second engagement part 112 further has an opening 112*c* whose end opposite to the bottom of the curved part 112*b* opens. This makes it possible to simply and easily attach/detach the second cam 132 to/from the actuated member 110.

Specifically, the second cam 132 is eccentric by a diameter that is smaller than the diameter of the rotary drive shaft 120. The second cam 132 is formed integrally with the rotary drive shaft 120 by performing a predetermined process (specifically, a cutting process) on the rotary drive shaft 120.

The second engagement part 112 is provided in such a position in the removable member 110*b* in the first one (which, in this example, is the front one) of the pair of actuated members 110 that the pressure roller 172 is brought into an inclined state (where the first side [which, in this example, is the front side] of the pressure roller 172 moves [or, in this example, becomes higher or lower] in the first direction W1 or the second direction W2 of the swinging directions W) or a parallel state with respect to the fixing roller 171 in a position in the operating state change region γ2*b* of the second cam 132 where the second engagement part 112 is actuated.

It should be noted that examples of the amount of inclination of the pressure roller 172 with respect to the fixing roller 171 includes, but are not limited to, approximately ±0.5 mm (approximately ±0.09 degree in term of the angle of inclination) in an A4 portrait size configuration (specifically, approximately 300 mm).

In the position in the operating state change region γ2*b* of the second cam 132 where the second engagement part 112 is actuated, rotating the second cam 132 in the first direction R1 of the directions of rotation R allows the second engagement part 112 to move in the first direction W1 of the swinging directions W. This makes it possible to incline the pressure roller 172 with respect to the fixing roller 171 so that the first side (which, in this example, is the front side) of the pressure roller 172 moves (or, in this example, becomes higher) in the first direction W1 of the swinging directions W. Further, in the position in the operating state change region γ2*b* of the second cam 132 where the second engagement part 112 is actuated, rotating the second cam 132 in the second direction R2 of the directions of rotation R allows the second engagement part 112 to move in the second direction W2 of the swinging directions W. This makes it possible to incline the pressure roller 172 with respect to the fixing roller 171 so that the first side (which, in this example, is the front side) of the pressure roller 172 moves (or, in this example, becomes lower) in the second direction W2 of the swinging directions W. Furthermore, in the position in the operating state change region γ2*b* of the second cam 132 where the second engagement part 112 is actuated, returning the second cam 132 from the first direction R1 or the second direction R2 of the directions of rotation R allows the second engagement part 112 to return from the first direction W1 or the second direction W2 of the swinging directions W. This makes it possible to make the pressure roller 172 parallel or substantially parallel to the fixing roller 171.

Incidentally, when the fixing pressure between the fixing roller 171 and the pressure roller 172 is equal to or higher than a predetermined pressure or is higher than the predetermined pressure, the fixing belt 173 is easily damaged if the fixing belt 173 deviates to the first side (front side) or the second side (rear side) and makes contact with various members (e.g. the fixing roller 171 and flanges 174*d* of the heating roller 174) that are adjacent to the fixing belt 173. On the other hand, when the fixing pressure between the fixing roller 171 and the pressure roller 172 is lower than the predetermined pressure or is equal to or lower than the predetermined pressure, damage to the fixing belt 173 can be avoided even if the fixing belt 173 deviates to the first side (front side) or the second side (rear side) and makes contact with various members (e.g. the fixing roller 171 and the flanges 174*d* of the heating roller 174) that are adjacent to the fixing belt 173.

In this respect, in the present embodiment, when the pair of first cams 131 bring the pressure roller 172 into the pressure adjustment state and/or the pressure release state against the fixing roller 171 in the positions in the operating state change regions γ1*b* where the first engagement parts 111 are actuated, the second cam 132 does not perform the belt deviation correction action on the second engagement part 112.

Specifically, the pair of first cams 131 retract the second cam 132 from the second engagement part 112 in the positions in the operating state change regions γ1*b* where the first engagement parts 111 are actuated. In this example, a first (in this example, front) actuated member 110 (which, in this example, is the removable member 110*b*) of the pair of actuated members 110 is provided with, in addition to the second engagement part 112, rotary drive shaft retraction parts 114 lined up at both ends of the second engagement part 112 in the directions of rotation R. In the positions in the operating state change regions γ1*b* where the first engagement parts 111 are actuated, the pair of first cams 131 retract, into the rotary drive shaft retraction parts 114, the second cam 132 and a part of the rotary drive shaft 120 that is adjacent to the second cam 132 or at least the part of the rotary drive shaft 120 that is adjacent to the second cam 132 (in this example, both the second cam 132 and the part of the rotary drive shaft 120 that is adjacent to the second cam 132).

In this example, the rotary drive shaft retraction parts 114 are configured to make the pressure roller 172 parallel or substantially parallel to the fixing roller 171. Specifically, the rotary drive shaft retraction parts 114 are configured to be insertion parts through which, in a position where they make the pressure roller 172 parallel or substantially parallel to the fixing roller 171, the rotary drive shaft 120 is inserted to be able to reciprocate in the turning directions V. The rotary drive shaft retraction parts 114 are provided in the actuated member 110 (which, in this example, is the removable member 110*b*) so that the rotary drive shaft 120 reciprocates in the turning directions V in the positions in the operating state change regions γ1*b* of the first cams 131 where the first engagement parts 111 are actuated. The size between the rotary drive shaft retraction parts 114 is a size that is slightly larger than the diameter of the rotary drive shaft 120 (i.e. such a size that the rotary drive shaft 120 can be smoothly inserted through the rotary drive shaft retraction parts 114). This makes it possible to set up a configuration so that when an operating state of the first engagement parts 111 is changed in the positions in the operating state change regions γ1*b* of the first cams 131 where the first engagement parts 111 are actuated, the action on the second engagement part 112 by the second cam 132 is not performed, and also makes it possible to insert the rotary drive shaft 120 through the rotary drive shaft retraction parts 114 to make the pressure roller 172 parallel or substantially parallel to the fixing roller 171.

Even with such a configuration in which when the operating state of the first engagement parts 111 is changed in the positions in the operating state change regions γ1*b* of the first cams 131 where the first engagement parts 111 are actuated (specifically, when the pressure roller 172 is in the pressure adjustment state against the fixing roller 171), the action (specifically, the belt deviation correction action) on the second engagement part 112 by the second cam 132 is not performed, damage to the fixing belt 173 can be avoided even if, when the fixing pressure between the fixing roller 171 and the pressure roller 172 is lower than the predetermined pressure or is equal to or lower than the predetermined pressure, the fixing belt 173 deviates and makes contact with various members (e.g. the fixing roller 171 and the flanges 174*d* of the heating roller 174) that are adjacent to the fixing belt 173.

Further, when the operating state of the first engagement parts 111 is changed in the positions in the operating state change regions γ1*b* of the first cams 131 where the first engagement parts 111 are actuated (specifically, when the pressure roller 172 is in the pressure adjustment state against the fixing roller 171), the pressure roller 172 can be made parallel or substantially parallel to the fixing roller 171. This makes it possible to minimize the occurrence of a deviation of the fixing belt 173.

Further, in this example, guide parts 115 that guide the second cam 132 located in the rotary drive shaft retraction parts 114 toward the contact parts 112*a* are provided between the rotary drive shaft retraction parts 114 and the contact parts 112*a*. Specifically, the guide parts 115 are formed so that the size between the opposed guide parts 115 becomes gradually smaller from the rotary drive shaft retraction parts 114 toward the contact parts 112*a*.

Drive Transmission Mechanism

In the present embodiment, the fixing device 17 further includes the drive transmission mechanism 180, which acts as drive transmission means for transmitting rotary drive force to the rotary drive shaft 120, and the rotary drive source 190, which acts as drive means for driving the rotary drive shaft 120 via the drive transmission mechanism 180 to rotate.

The drive transmission mechanism 180 is configured to transmit rotary drive force in a first direction of rotation A1 and rotary drive force in a second direction of rotation A2 from the rotary drive source 190 to the rotary drive shaft 120.

Specifically, the drive transmission mechanism 180 is a gear train including a plurality of gears. More specifically, the drive transmission mechanism 180 includes a first gear 181 that is coupled to a rotating shaft 191 of the rotary drive source 190, a second gear 182 that is coupled to the rotary drive shaft 120, and a relay gear group 180*a* that transmits rotary drive force from the first gear 181 to the second gear 182.

The relay gear group 180*a* includes a plurality of (in this example, three) combined gears (which, in this example, are a first combined gear 183, a second combined gear 184, and a third combined gear 185) obtained by coaxially combining gears that are different in outer diameter (number of teeth) from each other. The first combined gear 183 is configured such that its large-diameter gear intermeshes with the first gear 181 and its small-diameter gear intermeshes with a large-diameter gear of the second combined gear 184. The second combined gear 184 is configured such that its large-diameter gear intermeshes with the small-diameter gear of the first combined gear 183 and its small-diameter gear intermeshes with a large-diameter gear of the third combined gear 185. The third combined gear 185 is configured such that its large-diameter gear intermeshes with the small-diameter gear of the second combined gear 184 and its small-diameter gear intermeshes with the second gear 182.

The first combined gear 183, the second combined gear 184, and the third combined gear 185 have their respective rotating shafts 183*a*, 184*a*, and 185*a* rotatably fixed and supported on the image forming apparatus main body 210 (specifically, a main body frame [not illustrated]).

Control Section

As shown in FIG. 17, the image forming apparatus 200 further includes a control section 220 that exercises overall control over the image forming apparatus 200. It should be noted that the control section 220 may be included in the fixing device 17 or the drive mechanism 100.

The control section 220 includes a processing section 221 composed of a microcomputer such as a CPU and a storage section 222 including a nonvolatile memory such as a ROM and a volatile memory such as a RAM. The processing section 221 loads, onto the RAM of the storage section 222, a control program stored in advance in the ROM of the storage section 222 and executes the control program, whereby the control section 220 controls the actuation of the various constituent elements. The RAM of the storage section 222 provides the processing section 221 with regions serving as image memories in which to store a work area and image data, respectively.

Roller Press Sensing

The second gear 182 has a sensed part 182*a* in a part of the outer edge thereof (see FIG. 4). The sensed part 182*a* is sensed by a rotational position sensing section 186 that senses the rotational position of the rotary drive shaft 120.

In this example, the sensed part 182*a* is a protrusion that protrudes outward in the cross direction X. In this example, the rotational position sensing section 186 includes a movable component 186*a* that is turned on when pressed by external force and is turned off when not pressed by external force. The rotational position sensing section 186 is a sensor that is turned on when the movable component 186*a* is pressed by the sensed part 182*a* and that is turned off when the movable component 186*a* is released from being pressed by the sensed part 182*a*.

The rotational position sensing section 186 is electrically connected to an input system of the control section 220. This allows the control section 220 to recognize the home position (origin position) of the rotary drive shaft 120 by receiving an on signal from the rotational position sensing section 186 during the pressing of the movable component 186*a* by the sensed part 182*a*.

The rotary drive source 190 (which, in this example, is a stepping motor) is fixedly provided in the image forming apparatus main body 210 (specifically, the main body frame [not illustrated]) so that the rotating shaft 191 faces in the direction of the axis of rotation β3. The rotary drive source 190 is electrically connected to an output system of the control section 220.

Roller Press Action

The control section 220 is configured to control the start and stoppage of rotation of the pair of first cams 131 by outputting, to the rotary drive source 190, an actuating signal (specifically, a pulse signal) representing the rotational position (rotation angle) of the rotary drive shaft 120 with reference to the home position (origin position) of the rotary drive shaft 120 as obtained by the rotational position sensing section 186. This allows the control section 220 to, by rotating the pair of first cams 131 via the drive transmission mechanism 180 and the rotary drive shaft 120 by means of the rotary drive source 190, press the pressure roller 172 against the fixing roller 171, adjust the pressure of the pressure roller 172 against the fixing roller 171, and release the pressure roller 172 from being pressed against the fixing roller 171.

Belt Deviation Sensing

The fixing device 17 may include a belt position sensing section 187 that senses the position of the fixing belt 173 in the direction of the axis of rotation β1. The control section 220 may correct a deviation of the fixing belt 173 by swinging the pressure roller 172 in accordance with a result of sensing yielded by the belt position sensing section 187. This makes it possible to certainly correct a deviation of the fixing belt 173.

Specifically, the belt position sensing section 187 is provided lateral to the first side (which, in this example, is the front side) of the fixing belt 173 in the cross direction X. The belt position sensing section 187 senses a deviation of the fixing belt 173 in the direction of the axis of rotation β1 of the fixing belt 173.

In this example, the belt position sensing section 187 includes a transmissive light sensor 187*a* and a movable component 187*b* (specifically, an actuator) (see FIG. 8).

The transmissive light sensor 187*a* includes a light-emitting part 187*a*1 that emits light and a light-receiving part 187*a*2 that receives the light from the light-emitting part 187*a*1.

The movable component 187*b* is supported on a turning shaft 187*c* to be turnable in turning directions Q around an axis of the turning shaft 187*c* between a light-transmitting position and a light-blocking position. The movable component 187*b* includes a main body part 187*b*1 turnably provided on the turning shaft 187*c*, a sensed part 187*b*2 provided on the main body part 187*b*1, and a contact part 187*b*3 provided on the main body part 187*b*1 at a different angle in a circumferential direction from the sensed part 187*b*2.

The main body part 187*b*1 is a circular cylindrical member whose axial movement is regulated by a pair of regulating members 187*c*1 provided on the turning shaft 187*c*.

The sensed part 187*b*2 turns in a first direction Q1 or a second direction Q2 of the turning directions Q to take the light-blocking position, in which to block the light from the light-emitting part 187*a*1 to the light-receiving part 187*a*2 in the transmissive light sensor 187*a*, and the light-transmitting position, in which to transmit the light from the light-emitting part 187*a*1 to the light-receiving part 187*a*2.

The contact part 187*b*3 comes into contact with a first end (which, in this example, is a front end) of the fixing belt 173 in the cross direction X.

The movable component 187*b* is biased by a biasing member 187*d* (specifically, a coiled spring) in such a direction (which, in this example, is the first direction Q1 of the turning direction Q) that the contact part 187*b*3 comes into contact with the fixing belt 173.

Moreover, the movable component 187*b* is configured such that the sensed part 187*b*2 is located in the light-blocking position when the fixing belt 173 is in a reference position of the fixing roller 171 in the direction of axis of rotation β1 (e.g. the middle position of the fixing roller 171 in the direction of axis of rotation β1) and the fixing belt 187*b*2 is located in the light-transmitting position in the first direction Q1 or the second direction Q2 of the turning directions Q when the fixing belt 173 deviates to the first side (which, in this example, is the front side) or the second side (which, in this example, is the rear side) of the fixing roller 171 in the direction of axis of rotation β1.

The belt position sensing section 187 (specifically, the transmissive light sensor 187*a*) is electrically connected to the input system of the control section 220. This allows the control section 220 to recognize the presence or absence of a deviation of the fixing belt 173 by receiving an off signal or an on signal from the belt position sensing section 187 through the light-receiving part 187*a*2 with the sensed part 187*b*2 in the light-blocking position or the light-transmitting position.

Belt Deviation Correction Action

The control section 220 is configured to, in the positions in the operating state maintenance regions γ1*a* of the pair of first cams 131 where the first engagement parts 111 are actuated, control the start and stoppage of rotation of the second cam 132 by outputting, to the rotary drive source 190, an actuating signal (specifically, a pulse signal) representing the rotational position (rotation angle) of the rotary drive shaft 120 with reference to the presence or absence of a deviation of the fixing belt 173 as obtained by the belt position sensing section 187.

Specifically, when having detected a deviation of the fixing belt 173 by means of the belt position sensing section 187, the control section 220 first moves the second engagement part 112 in the first direction W1 of the swinging directions W by rotating the second cam 132 in the first direction R1 of the directions of rotation R in the positions in the operating state maintenance regions γ1*a* of the pair of first cams 131 where the first engagement parts 111 are actuated, and then inclines the pressure roller 172 with respect to the fixing roller 171 so that the first side (which, in this example, is the front side) of the pressure roller 172 moves (or, in this example, becomes higher) in the first direction W1 of the swinging directions W.

Next, when not detecting the returning of the fixing belt 173 to the reference position by means of the belt position sensing section 187 even when a predetermined period of time passes, the control section 220 moves the second engagement part 112 in the second direction W2 of the swinging directions W by rotating the second cam 132 in the second direction R2 of the directions of rotation R in the positions in the operating state maintenance regions γ1*a* of the pair of first cams 131 where the first engagement parts 111 are actuated, and then inclines the pressure roller 172 with respect to the fixing roller 171 so that the first side (which, in this example, is the front side) of the pressure roller 172 moves (or, in this example, becomes lower) in the second direction W2 of the swinging directions W.

Moreover, upon detecting the returning of the fixing belt 173 to the reference position by means of the belt position sensing section 187, the control section 220 stops the rotation of the second cam 132 in the positions in the operating state maintenance regions γ1*a* of the pair of first cams 131 where the first engagement parts 111 are actuated.

This allows the control section 220 to correct a deviation of the fixing belt 173 by rotating the second cam 132 via the drive transmission mechanism 180 and the rotary shaft 120 by means of the rotary drive source 190 in the positions in the operating state maintenance regions γ1*a* of the pair of first cams 131 where the first engagement parts 111 are actuated.

Further, the control section 220 is configured not to control the belt deviation correction action on the second cam 132 in the positions in the operating state maintenance regions γ1*a* of the pair of first cams 131 where the first engagement parts 111 are actuated (specifically, the positions where the pressure roller 172 is brought into the pressure adjustment state and/or the pressure release state against the fixing roller 171).

It should be noted that the belt position sensing section 187 may be configured to sense a direction of deviation of the fixing belt 173 and the control section 220 may be configured to recognize the direction of deviation of the fixing belt 173 and perform the belt deviation correction action.

Other Embodiments

It should be noted that although, in the present embodiment, the belt deviation correction device 300 is applied to the fixing device 17, which conforms to a belt method, it may be applied to a conveying device that conforms a belt method (e.g. the primary transfer belt device 6, the secondary belt device 10, or the like).

Further, although, in the present embodiment, the plurality of actuated parts and the plurality of actuating parts are two actuated parts and two actuating parts, they may be three or more actuated parts and three or more actuating parts.

Further, although, in the present embodiment, the conveyed body is an endless belt and a deviation of the endless belt is corrected, the conveyed body may be a sheet and a deviation of the sheet may be corrected.

The present disclosure is not limited to the embodiments described above but may be carried out in other various forms. Therefore, the embodiments are mere examples in every way and should not be interpreted in a limited way. The scope of the present disclosure is indicated by the scope of the claims and is not bound by the main body of the specification in any way. Furthermore, all modifications and alternations that pertain to the scope of equivalents of the scope of the claims fall within the scope of the present disclosure.

The present disclosure contains subject matter related to that disclosed in Japanese Priority Patent Application JP 2017-80828 filed in the Japan Patent Office on Apr. 14, 2017, the entire contents of which are hereby incorporated by reference.

What is claimed is:

1. A belt deviation correction device for correcting a deviation of an endless belt wound around a plurality of rollers, comprising:

a pressing roller that is pressed from outside the endless belt wound around the plurality of rollers; and a drive mechanism that drives a plurality of actuated parts that are different from each other in order to swing the pressing roller, wherein the pressing roller is configured to swing in such a way as to be inclined with respect to the plurality of rollers, a deviation of the endless belt in a direction of an axis of rotation of the plurality of rollers is corrected by swinging the pressing roller, and the drive mechanism includes:

a single drive part to which a drive force is transmitted from a single drive source, and a plurality of actuating parts provided on the single drive part so that in actuating a first actuated part and a second actuated part of the plurality of actuated parts separately with the drive force from the single drive part, a first action on the first actuated part and a second action on the second actuated part do not affect each other.

2. The belt deviation correction device according to claim 1, further comprising a belt position sensing section that senses a position of the endless belt in the direction of the axis of rotation of the plurality of rollers, wherein the deviation of the endless belt is corrected by swinging the pressing roller in accordance with a result of sensing yielded by the belt position sensing section.

3. The belt deviation correction device according to claim 1, wherein a first actuating part of the plurality of actuating parts has an operating state maintenance region in which to maintain an operating state of the corresponding first actuated part, a second actuating part of the plurality of actuating parts has an operating state change region in which to change an operating state of the corresponding second actuated part, and when an operating state of the first action on the first actuated part is maintained in the operating state maintenance region of the first actuating part, an operating state of the second action on the second actuated part is changed in the operating state change region of the second actuating part.

4. The belt deviation correction device according to claim 1, wherein a first actuating part of the plurality of actuating parts has an operating state change region in which to change an operating state of the corresponding first actuated part, and when an operating state of the first action on the first actuated part is changed in the operating state change region of the first actuating part, the second action on the second actuated part by the second actuating part is not performed.

5. The belt deviation correction device according to claim 1, wherein the single drive source is a rotary drive source that outputs rotary drive force, the single drive part is a rotary drive shaft to which the rotary drive force from the rotary drive source is transmitted, at least two actuating parts of the plurality of actuating parts are constituted by cams, a first cam and a second cam of the cams are provided on the rotary drive shaft so that the first action in which the first cam actuates the first actuated part and the second action in which the second cam actuates the second actuated part do not affect each other.

6. The belt deviation correction device according to claim 5, wherein the first cam and the second cam are provided on the rotary drive shaft so that a displacement of a diameter of the first cam and a displacement of a diameter of the second cam are not in phase with each other.

7. The belt deviation correction device according to claim 5, wherein the drive mechanism further includes an actuated member in which the first actuated part and the second actuated part are provided, the first cam causes the actuated member to reciprocate in first directions of reciprocation by means of the first actuated part, and the second cam causes the actuated member to reciprocate in second directions of reciprocation that are different from the first directions of reciprocation by means of the second actuated part.

8. The belt deviation correction device according to claim 7, wherein the first directions of reciprocation include turning directions of turning around an axis of turning that is parallel or substantially parallel to a direction of an axis of rotation of the rotary drive shaft, the second directions of reciprocation include swinging directions of swinging around an axis of swinging that intersects the axis of turning, and the actuated member is configured to be turnable in the turning directions and swingable in the swinging directions.

9. The belt deviation correction device according to claim 7, wherein the actuated member includes a main body member in which the first actuated part is provided and a removable member, removably provided in the main body member, in which the second actuated part is provided.

10. The belt deviation correction device according to claim 7, wherein the actuated member includes a pair of actuated members located on both sides of the rotary drive shaft in a direction of an axis of rotation of the rotary drive shaft, and the first cam includes a pair of first cams provided on both sides of the rotary drive shaft in the direction of the axis of rotation and is configured to cause the pair of actuated members to reciprocate in the same direction of the first directions of reciprocation when the rotary drive shaft is driven to rotate on the axis of rotation.

11. The belt deviation correction device according to claim 7, wherein the actuated member includes a pair of actuated members located on both sides of the rotary drive shaft in a direction of an axis of rotation of the rotary drive shaft, and the second cam is a single second cam provided on one side of the rotary drive shaft in the direction of the axis of rotation and is configured to cause that one of the pair of actuated members on which the single second cam is provided to reciprocate in the second directions of reciprocation.

12. The belt deviation correction device according to claim 7, wherein the actuated member includes a pair of actuated members located on both sides of the rotary drive shaft in a direction of an axis of rotation of the rotary drive shaft, and the second cam includes a pair of second cams provided on both sides of the rotary drive shaft in the direction of the axis of rotation and is configured to cause the pair of actuated members to reciprocate in opposite directions of the second directions of reciprocation when the rotary drive shaft is driven to rotate on the axis of rotation.

13. The belt deviation correction device according to claim 1, wherein a first actuating part of the plurality of actuating parts performs a roller press action of pressing the pressing roller against any one of the plurality of rollers, and a second actuating part of the plurality of actuating parts performs a belt deviation correction action of correcting a deviation of the endless belt.

14. A fixing device comprising the belt deviation correction device according to claim 1, wherein the plurality of rollers include a fixing roller and a heating roller, the pressing roller is a pressure roller, and the endless belt is a fixing belt.

15. An image forming apparatus comprising:

the fixing device according to claim 14.

16. An image forming apparatus comprising:

the belt deviation correction device according to claim 1.

17. A belt deviation correction method for correcting a deviation of an endless belt wound around a plurality of rollers, comprising:

correcting a deviation of the endless belt in a direction of an axis of rotation of the plurality of rollers by swinging a pressing roller so that the pressing roller is inclined with respect to the plurality of rollers, the pressing roller being pressed from outside the endless belt wound around the plurality of rollers, wherein the belt deviation correction method causes the pressing roller to swing by driving a plurality of actuated parts that are different from each other, the belt deviation correction method includes using a single drive part to which a drive force is transmitted from a single drive source, and a plurality of actuating parts provided on the single drive part, and in response to the single drive part actuating a first actuated part and a second actuated part of the plurality of actuated parts separately with the drive force from the single drive part, a first action on the first actuated part and a second action on the second actuated part do not affect each other.

* * * * *